US007291987B2

(12) United States Patent
Chang et al.

(10) Patent No.: US 7,291,987 B2
(45) Date of Patent: Nov. 6, 2007

(54) POWER SUPPLY SYSTEM FOR FLAT PANEL DISPLAY DEVICES

(75) Inventors: A-Jung Chang, Taipei (TW); Wen-Lin Chen, Jhonghe (TW); Chen-An Chiang, Sanchong (TW); Hui-Chen Chou, Keelung (TW); Yi-Cheng Liu, Banciao (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 108 days.

(21) Appl. No.: 11/155,698

(22) Filed: Jun. 17, 2005

(65) Prior Publication Data

US 2006/0284568 A1 Dec. 21, 2006

(51) Int. Cl.
*H05B 41/24* (2006.01)

(52) U.S. Cl. ..... 315/282; 315/291; 315/312

(58) Field of Classification Search ..... 315/209 R, 315/212, 224, 276, 282, 291, 301–302, 312
See application file for complete search history.

(56) References Cited

U.S. PATENT DOCUMENTS 5,495,149 A * 2/1996 Hiramatsu et al. ..... 315/209 R
5,907,223 A * 5/1999 Gu et al. ..... 315/247
6,947,024 B2 * 9/2005 Lee et al. ..... 345/102
2004/0155596 A1 * 8/2004 Ushijima et al. ..... 315/224
2005/0212790 A1 * 9/2005 Lin et al. ..... 345/204
2005/0237010 A1 * 10/2005 Ying et al. ..... 315/312
2006/0113926 A1 * 6/2006 Lin ..... 315/291
2006/0273745 A1 * 12/2006 Wey et al. ..... 315/312
2007/0007908 A1 * 1/2007 Kim et al. ..... 315/282
2007/0007910 A1 * 1/2007 Kim et al. ..... 315/282
2007/0018593 A1 * 1/2007 Kuo ..... 315/312
2007/0126369 A1 * 6/2007 Meng et al. ..... 315/282

* cited by examiner

*Primary Examiner*—Trinh Vo Dinh
(74) *Attorney, Agent, or Firm*—Wei Te Chung

(57) ABSTRACT

A power supply system for powering backlight lamps in a flat panel display with reduced dimensions and increased power efficiency. The power supply system includes a converter circuit for converting an alternating current (AC) signal from an AC power source to a high direct current (DC) signal, and a high voltage (HV) inverter system that includes a power stage circuit, a transformer circuit, and a current balance circuit. The HV inverter system is coupled to the converter circuit and specifically configured to convert the high DC signal into an AC output signal to power the backlight lamps.

15 Claims, 21 Drawing Sheets

POWER SUPPLY SYSTEM FOR FLAT PANEL DISPLAY DEVICES

TECHNICAL FIELD

The invention relates generally to a power supply system used in a flat panel display, and more particularly, to an LCD (Liquid Crystal Display) Integrated Power Supply (LIPS) with a high voltage (HV) inverter system to power a flat panel display device such as backlight lamps.

BACKGROUND

Portions of the disclosure of this patent document may contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

One or more cold cathode fluorescent lamps (CCFL) or External Electrode Fluorescent lamps (EEFL) are generally used as backlight lamps for an LCD module in flat panel displays (e.g., liquid crystal displays, plasma display panels, plasma low-profile, and liquid crystal on silicon). One or more of the backlight lamps in the LCD module are typically driven by a DC-AC inverter, which takes a DC (Direct Current) signal with a voltage of, e.g., 5 to 24 volts from a DC-DC converter, and transforming such into an appropriate AC (Alternating Current) signal.

A typical power supply system for supplying power to the backlight lamps is shown in FIG. 1. The power supply system includes an AC source input 102 from a socket passing through an AC-DC rectifier circuit 106, a Power Factor Correction (PFC) boost circuit 108, then either a first DC-DC converter circuit 109 and a DC-AC inverter circuit 111 to provide the backlight lamps 112 with AC power, or a second DC-DC converter circuit 114 to provide DC power to an LCD panel 116 or other elements. The typical power supply system requires multiple conversions from AC to DC and back to AC. For instance, an input AC voltage of 90-132 Vac or 180-264 Vac is first converted to a DC voltage of 120-190 Vdc or 250 or 380 Vdc via the AC-DC rectifier 106 and PFC boost circuit 108, and then either converted to an output DC voltage of 12 Vdc or 5 Vdc, or converted to an output AC voltage appropriate for the backlight lamps via DC-DC converter 109 and DC-AC inverter. As a result, such system occupies large space, yields high power consumption, and incurs high material or production costs. Additionally, such system has lower power efficiency from a higher power loss.

SUMMARY

Thus, an embodiment of the invention provides a power supply system having reduced dimensions and increased power efficiency. The power supply system in one exemplary embodiment comprises a high voltage (HV) inverter system and a DC-DC converter circuit coupled in parallel and having one end concurrently connected to an AC-DC converter circuit. The AC-DC converter circuit, which has a rectifier and a power factor correction (PFC) boost for rectifying an alternating current (AC) signal into a direct current (DC) signal that ranges from 370 to 420 volts, receives an AC signal from an AC power source, and converts the received AC signal into a high DC signal. The DC-DC converter circuit receives the high DC signal from the AC-DC converter circuit, and configured to generate a regulated DC output signal to an LCD panel. Furthermore, the high voltage (HV) inverter system, comprising a transformer circuit, a power stage circuit coupled to a primary side of the transformer circuit, and a current balance circuit coupled between a secondary side of the transformer circuit and the backlight lamps, receives the high DC signal from the first converter circuit, and configured to convert the high DC signal into an AC output signal appropriate to power the backlight lamps.

Particularly, the transformer circuit has a transformer with a primary side coupled to the power stage circuit, and a secondary side coupled to the current balance circuit. The current balance circuit has a plurality of current transformers, each of which has at least two windings each with an input and output winding end that are connected in a multi-tier configuration to provide balance to currents flowing to the backlight lamps. The multi-tier configuration has at least a top tier and a bottom tier, with the top tier having one or more current transformer receiving AC signals from the transformer circuit, and the bottom tier having a plurality of the current transformers with windings that correspond to the number of the backlight lamps, and each connected to a high voltage end of the backlight lamps. Also, the top tier in the multi-tier configuration can have either one current transformer to receive a positive polarity current from the transformer circuit, or two current transformers to each receive a positive or a negative polarity current from the transformer circuit.

The multi-tier configuration may have a middle tier that is disposed between the top and bottom tiers. The middle tier includes a set of symmetrically or asymmetrically arranged current transformers that can number no more than the current transformers of the bottom tier. In the symmetrical arrangement, an output end of the current transformer at the top tier is coupled exclusively to one of the input winding ends of another current transformer at the middle tier. In the asymmetrical arrangement, an output end of the current transformer at the top tier is coupled to both input ends of the current transformer at the middle tier.

Two mirror groups of the current transformers each in the aforementioned multi-tier configuration can be symmetrically arranged relative to the backlight lamps for connection thereto. In this instance, each top or bottom tier of the mirror sets would have one current transformer to receive either a positive or negative polarity current from the transformer circuit.

In this exemplary embodiment, the HV inverter system can further comprise a feedback and protection circuit that receives current values from the current balance circuit and the backlight lamps, a photo coupler that receives an input signal from the feedback and protection circuit, a pulse-width-modulation controller, that receives rectified signals from the photo coupler, and a driver circuit that outputs, signals from the pulse-width-modulation controller to the power stage circuit to control the current values of the current balance circuit and backlight lamps.

In another exemplary embodiment, the HV inverter system can further comprise a feedback and protection circuit that receives current values from the current balance circuit and the backlight lamps, a pulse-width-modulation controller that receives an input signal from the feedback and protection circuit and provides output signals, and a driver circuit that receives the output signals from the pulse-width-modulation controller and provides processed output signals to the power stage circuit to control the current values of the current balance circuit and backlight lamps.

The invention also discloses a methodology for powering backlight lamps comprising the steps of rectifying an alternating current (AC) signal received from an AC power source to a high direct current (DC) signal; generating a regulated DC output signal to an LCD panel from the high DC signal; and converting the high DC signal an AC voltage to power the backlight lamps, wherein the converting steps comprise converting the high DC signal with a power stage circuit, inducing the AC signal with a transformer, and balancing the AC signal with a current balance circuit. Another step of detecting feedback signals from the backlight lamps and the current balance circuit, and outputting output signals to the power stage circuit.

Further features and advantages of the invention, as well as the structure and operation of various exemplary embodiments of the invention, are described in detail below with reference to the accompanying drawings.

BRIEF DESCRIPTION OF THE DRAWINGS

The foregoing and other features and advantages of the invention will be apparent from the following, more particular description of one or more exemplary embodiments of the invention, as illustrated in the accompanying drawings wherein like reference numbers generally indicate identical, functionally similar, and/or structurally similar elements. The left most digits in the corresponding reference number generally indicate the drawing in which an element first appears.

DETAILED DESCRIPTION OF EXEMPLARY EMODIMENTS OF THE INVENTION

While specific exemplary examples, environments and embodiments are discussed below, it should be understood that this is done for illustration purposes only. A person skilled in the relevant art will recognize that other components and configurations can be used without parting from the spirit and scope of the invention. In fact, after reading the following description, it will become apparent to a person skilled in the relevant art how to implement the invention in alternative examples, environments and exemplary embodiments.

Figure 1:
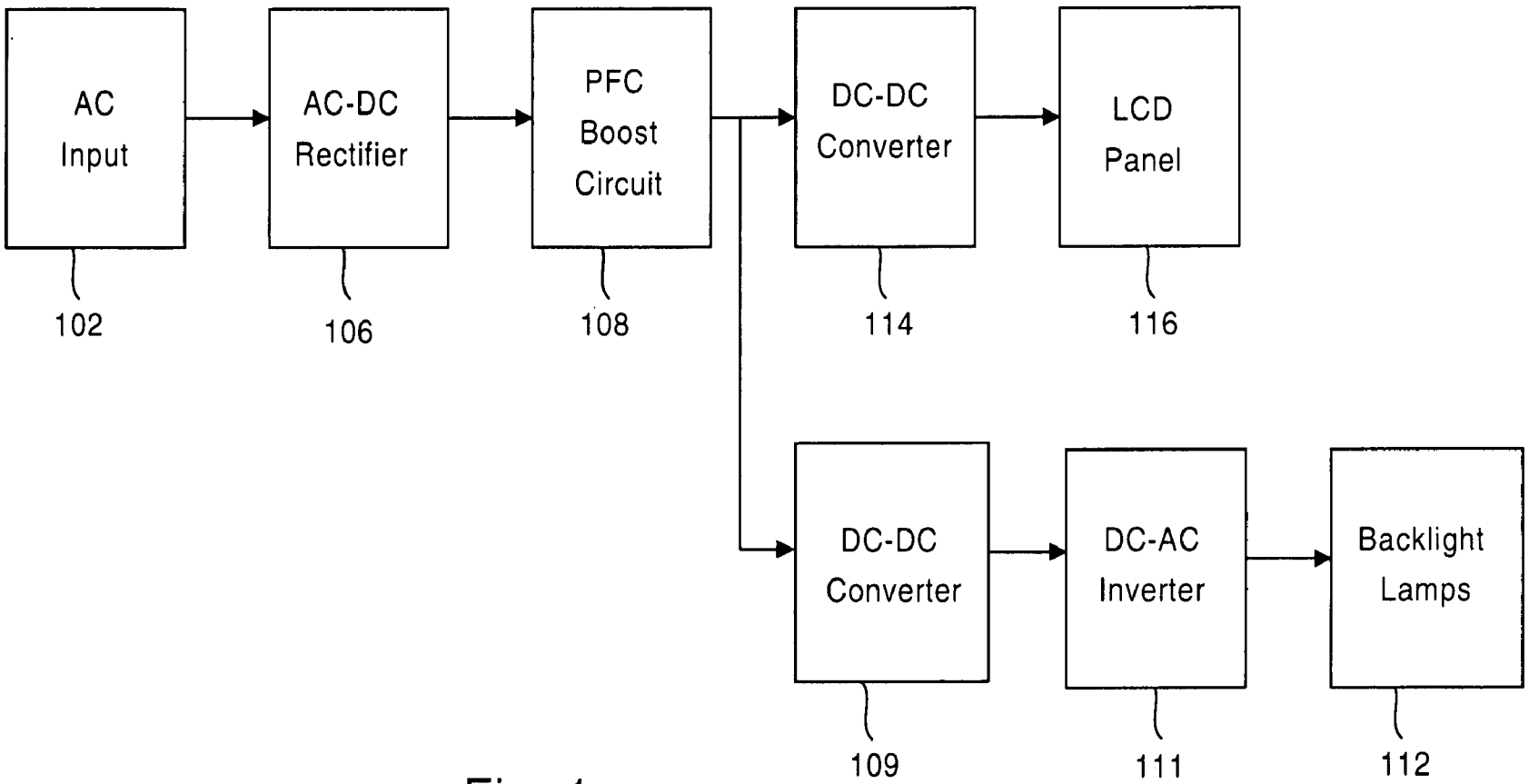
Fig. 1 Related Art
FIG. 1 is a block diagram illustrating a conventional power supply system for LCD backlight lamps.
Figure 2:
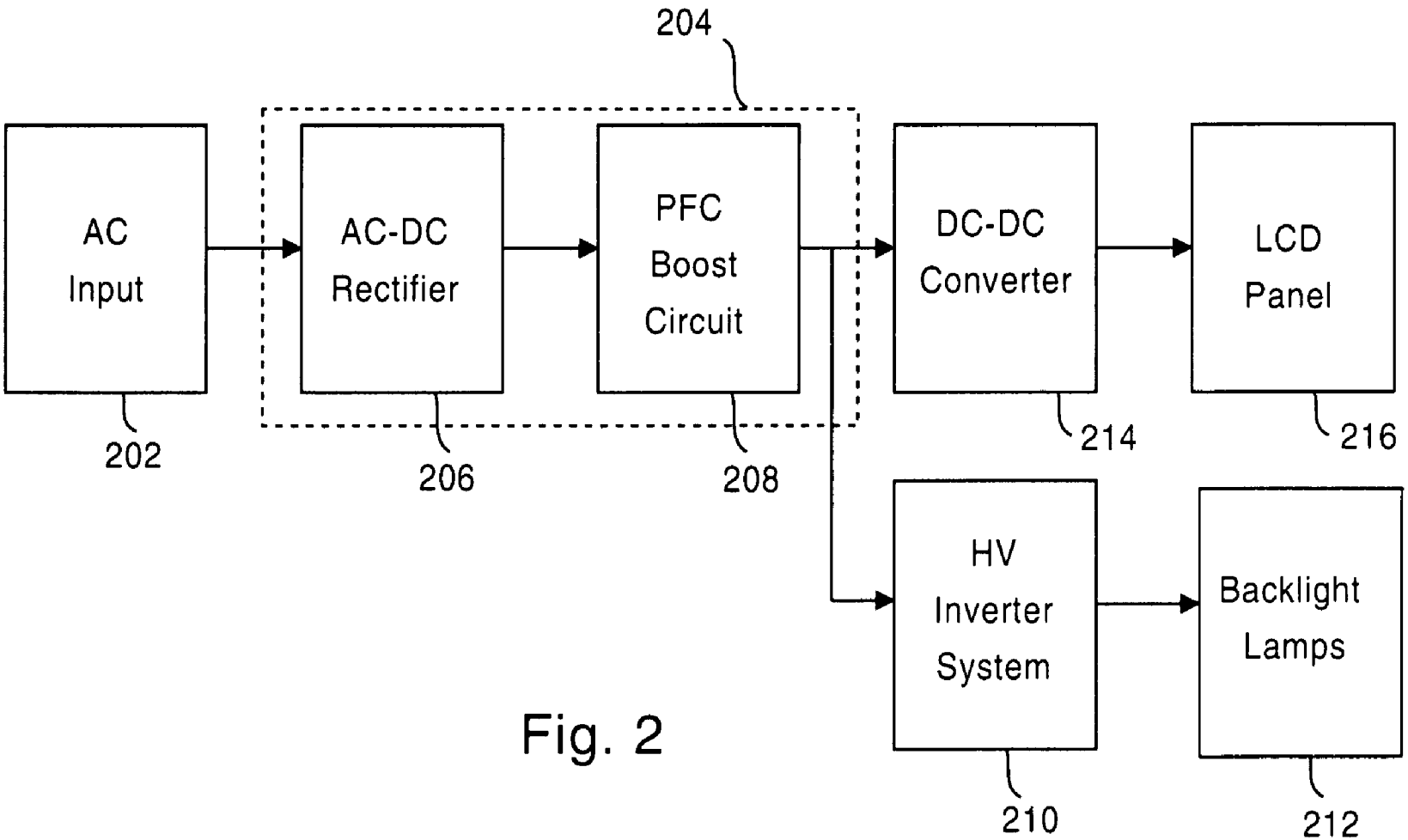
FIG. 2 is a block diagram illustrating a power supply system for driving backlight lamps of the invention.

FIG. 2 is a block diagram of the power supply system for backlight lamps of an exemplary embodiment of the invention. In FIG. 2, the power supply system includes an AC input source 202 for supplying an alternating current (AC) to an AC-DC converter circuit 204, having a rectifier circuit 206 and a power factor correction (PFC) boost circuit 208, to convert the general AC voltage signal into a direct current (DC) voltage signal.

The PFC boost circuit 208 serves to generate a regulated, high voltage DC output, which ranges from 370 to 420 volts, while regulating the power factor of the power drawn from the rectifier circuit 206 such that the current will be proportional to the input voltage at any particular instant. Namely, the PFC boost circuit 208 is a boost converter receiving a rectified AC signal and generating a high voltage output, and is operable to adjust the high power factor of the rectified AC signal to generate the high voltage output.

A high voltage (HV) DC/AC inverter system 210 is coupled to the high voltage output of the PFC boost circuit and converts the regulated high DC voltage from the PFC boost circuit into an appropriate AC voltage output to drive one or more backlight lamps 212.

A DC-DC converter 214 is also coupled to the high voltage output of the PFC boost circuit 208, and is configured to generate a regulated output voltage. The generated power from the DC-DC converter 214 is used to power all circuits in the LCD panel 216 except for the CCFL/EEFL backlight lamps.

The DC-DC converter 214 and HV DC/AC inverter system 210 are parallel to each other with one end concurrently connected to the PFC boost circuit's output, and the other end respectively outputting the desired powers. Such configuration means that the dimensions for the occupied space are reduced, and power efficiency is increased. Particularly, since the LCD module adopts the HV DC/AC inverter system to convert a high direct current voltage into an alternating current voltage, the required circuitry is simplified and space occupied in the LCD module is reduced, which in turn reduces fabrication costs.

Figure 3:
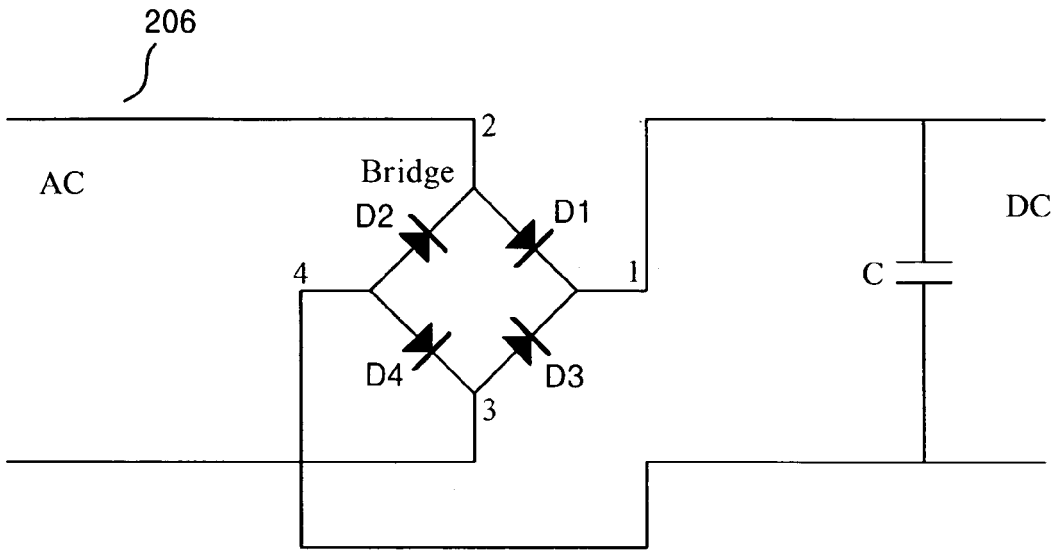
FIG. 3 is a circuit diagram illustrating an AC-DC rectifier circuit in the power supply system as shown in FIG. 2.

FIG. 3 is a circuit diagram showing the AC-DC rectifier circuit 206. Barrier diodes D1-D4 are set in a full bridge configuration, with a capacitor (C) connected in parallel with barrier diodes D3 and D4.

Figure 4:
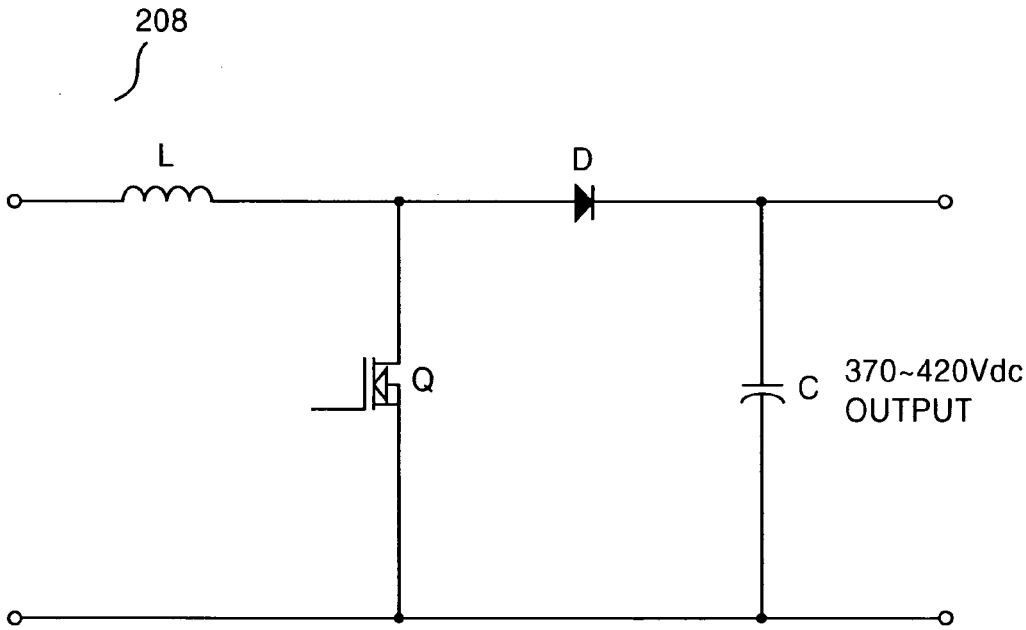
FIG. 4 is a circuit diagram illustrating a PFC boost circuit in the power supply system as shown in FIG. 2.

FIG. 4 is a circuit diagram showing the PFC boost circuit 208, which is a boost DC-DC converter having a function of a power factor correction. The PFC boost circuit 208 includes an inductor (L), MOSFET (Q), capacitor (C), and diode rectifier (D). The inductor is connected to both the MOSFET (Q) and the diode rectifier (D). One end of the capacitor (C) is connected to an anode of the diode (D), and the other end of the capacitor (C) is connected to the source of the MOSFET (Q). The PFC boost circuit 208 raises the rectified voltage provided from the AC-DC rectifier circuit 206, and provides the raised voltage to both the HV inverter system 210 and the DC-DC converter circuit 214.

Figure 5:
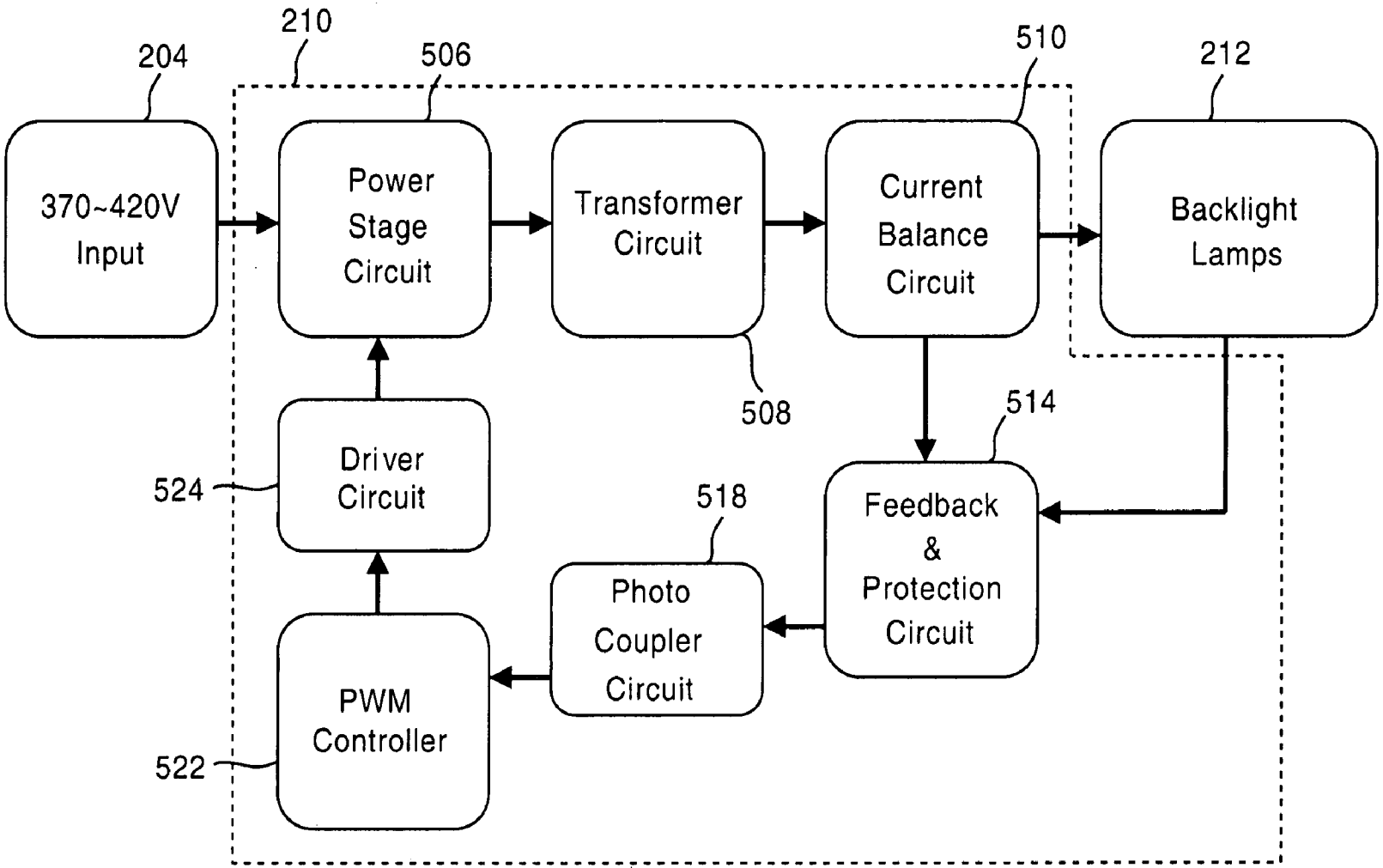
FIG. 5 is a block diagram illustrating an HV inverter system in the power supply system according to a first exemplary embodiment.

Referring to FIG. 5, a block diagram for the HV inverter system 210 is shown. The DC signal that ranges from 370 to 420 volts is inputted to the HV inverter system 210 from the AC-DC converter circuit 204 (FIG. 2). The HV inverter system 210 has at least a power stage circuit 506, a transformer circuit 508, and a current balance circuit 510. The power stage circuit 506 is of a half-bridge configuration, which typically includes power metal-oxide semiconductor field-effect transistors (MOSFETs) and a storage capacitor. In some embodiments, the power stage circuit 506 can also be embodied by other kinds of inverter configuration driven under a high voltage having a voltage level between 370 and 420 volts, such as a royer topology, push-pull topology, or full-bridge topology.

The DC signal that ranges from 370 to 420 volts is converted to an AC signal via the power stage circuit 506 with the half-bridge topology, and the AC signal passes through the transformer circuit 508 and is fed to a current balance circuit 510, which is coupled to the backlight lamps (CCFL/EEFL) 212. The current balance circuit 510 ensures that current flowing to each of the backlight lamps 212 is balanced or equal. Particularly, the current balance circuit comprises a plurality of current transformers (CT), generating magnetic fluxes at the opposing windings such that electric currents outputted therefrom are balanced.

In additional to the power stage circuit 506, transformer circuit 508, and current balance circuit 510, the HV inverter system also has a feedback and protection circuit 514, a photo coupler circuit 518, a pulse width modulation (PWM) controller 522, and a driver circuit 524. The feedback and protection circuit 514 is added to process current values from both the current balance circuit 510 and the backlight lamps 212, and provides output signal to the PWM controller 522 via the photo coupler circuit 518. The feedback and protection circuit 514 receives current values from the current balance circuit 510 and the backlight lamps 212, and subsequently generates a current signal to the photo coupler circuit 518. Output signals from the photo coupler circuit 518, which are in the form of rectified AC input signal, are directed to the PWM controller 522, outputting signals to the driver circuit 524. Specifically, the signals from the PWM controller 522 are directed to the power stage circuit 506 via the driver circuit 524 to protect the backlight lamps 212 and the power supply system.

Figure 6A:
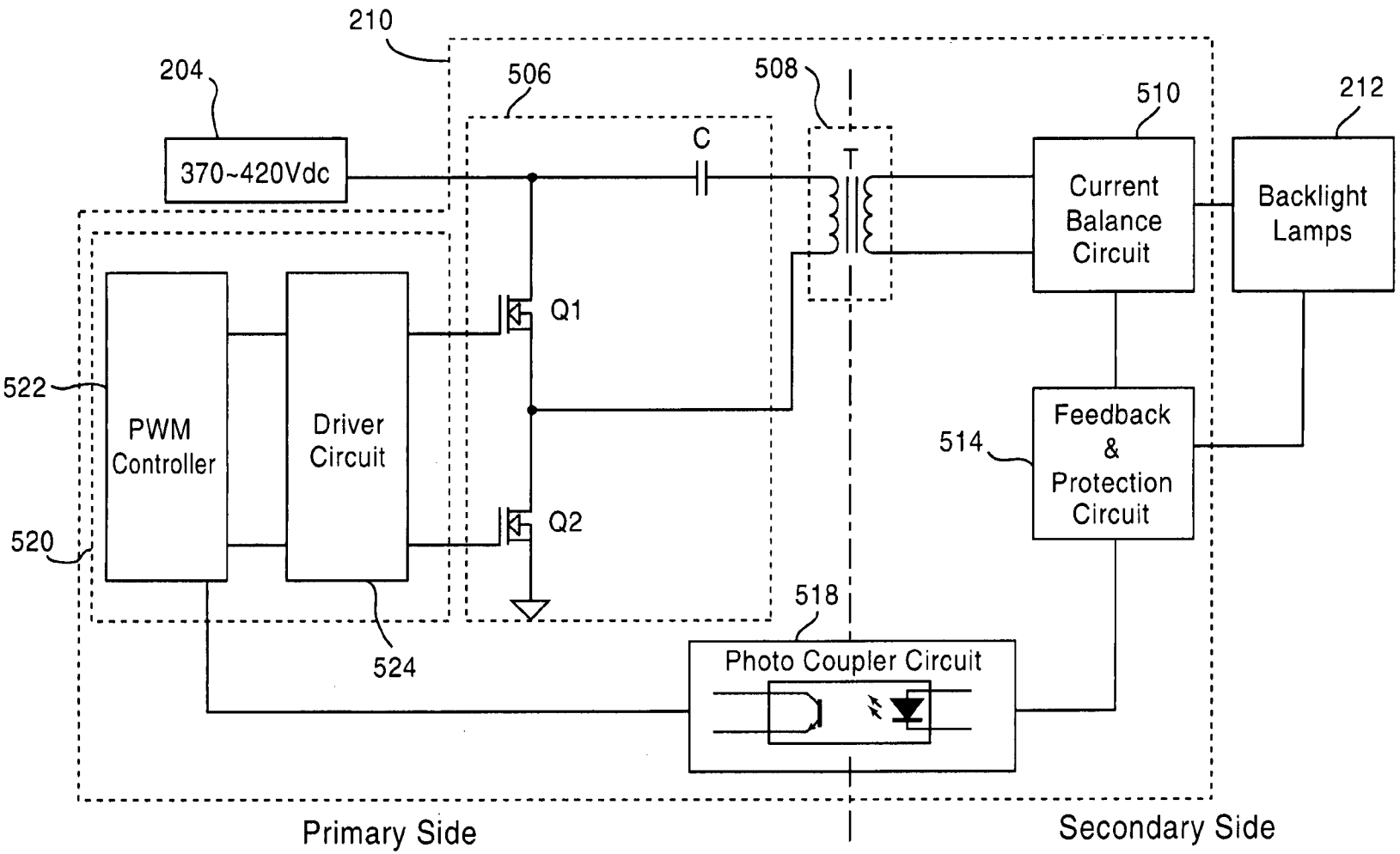
FIGS. 6A and 6B are selective circuit diagrams showing topology for power stage, transformer, and photo coupler circuits of the HV inverter system as shown in FIG. 5.
Figure 6B:
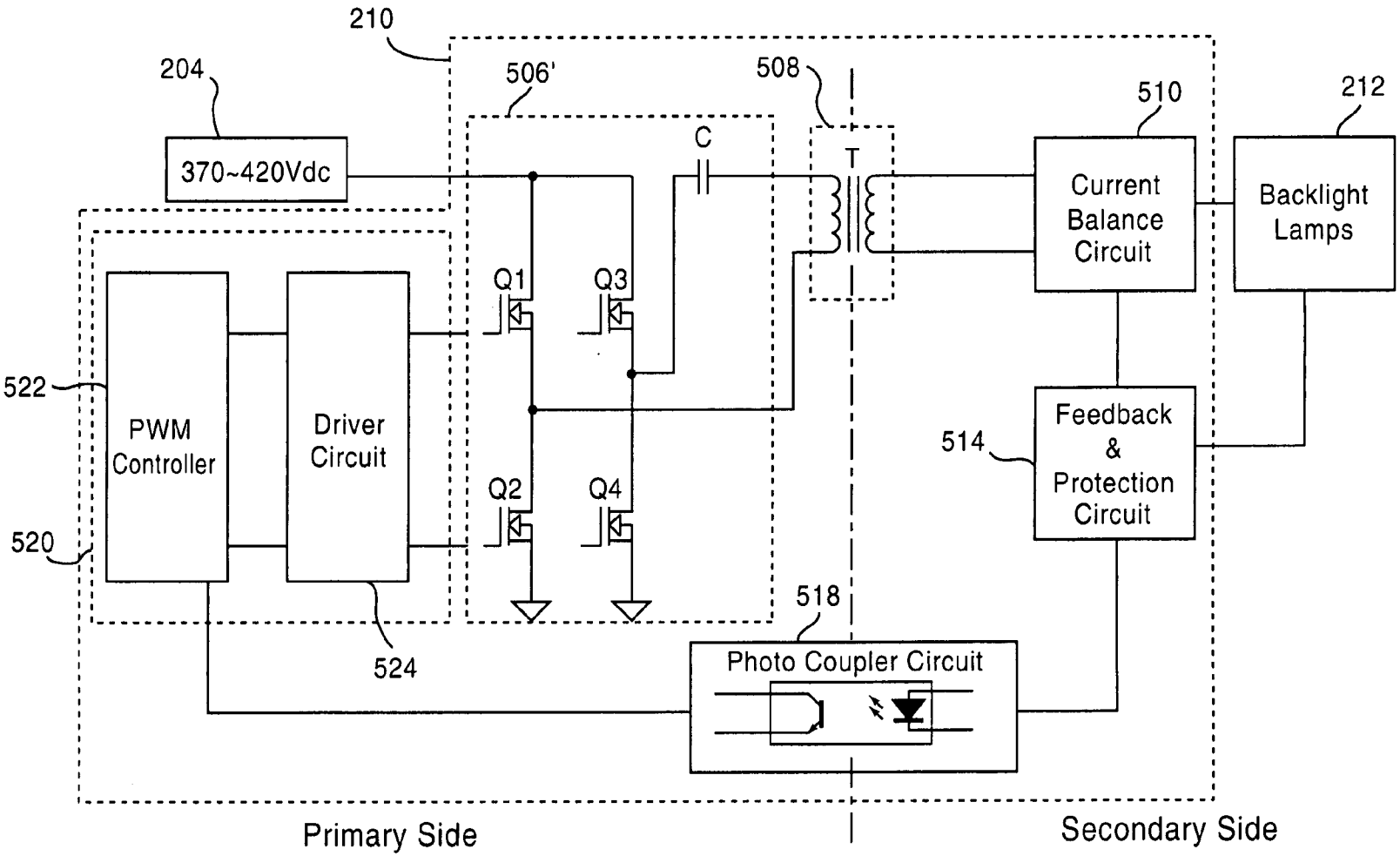

FIGS. 6A and 6B more clearly depict the circuitry in the power stage circuit 506, transformer circuit 508, and photo coupler circuit 518 as shown in FIG. 5. Particularly, in the power stage circuit 506 as shown in FIG. 6A, Q1 and Q2 denote main switching elements, each including a pair of power MOSFETs. The power MOSFETs Q1 and Q2 are coupled in a half-bridge manner and act as electronic switches for upper and lower halves of the power stage circuit 506. For instance, by switching on Q1, current is made to flow through the upper half of the power stage circuit 506. Conversely by switching on Q2, the current is made to flow the opposite way through the lower half of the power stage circuit 506. By switching the two MOSFETs on alternately, the current is made to flow first in one half and then in the other, producing an alternating magnetic flux. Alternatively, FIG. 6B shows a full bridge configuration for the power stage circuit 506 in which a drain and a source from MOSFETs Q1 and Q2 are connected directly to the transformer circuit 508, while a drain and a source of MOSFETs Q3 and Q4 are connected to the transformer circuit 508 via a capacitor (C).

The transformer circuit 508 in FIGS. 6A and 6B is depicted by a transformer (T) with a primary side and a secondary side. More specifically, the primary side of the transformer (T) has the capacitor (C) for signal block and storage. The secondary side of the transformer (T) steps up the AC voltage and outputs it to the backlight lamps 212 via the current balance circuit 510.

An exemplary circuit for the photo coupler circuit 518 is also shown in FIG. 6. The photo coupler circuit 518 has one light emitting diode (LED) on the input side. When current is applied to the LED, a signal is transferred to the output side of the photo coupler circuit 518. Other types of photo coupler, such as photo transistor and detector plate, can also be used in the photo coupler circuit 518 to insulate and transmit signal.

Figure 7A:
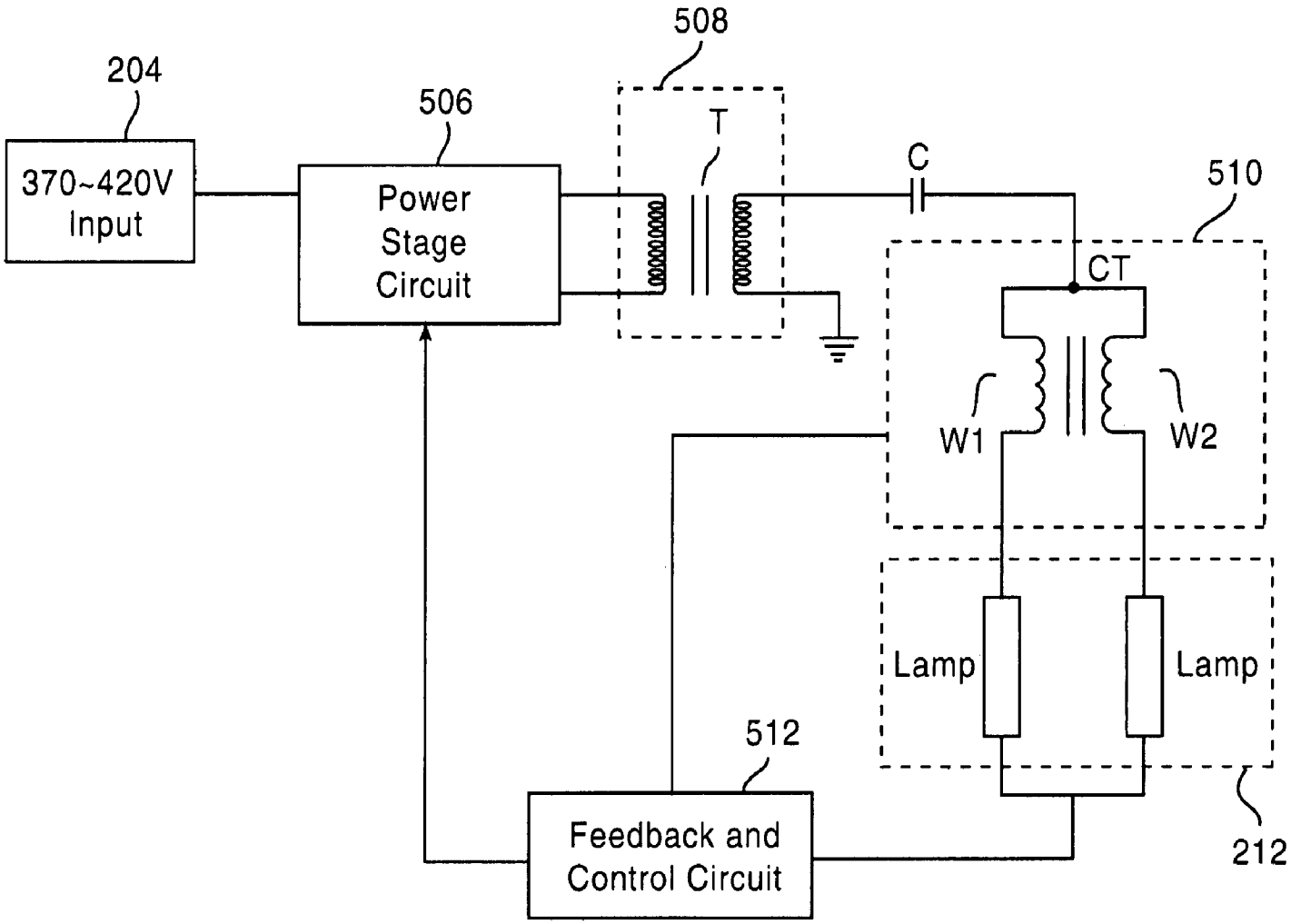
FIG. 7A is a selective circuit diagram showing a basic current balance circuit topology for the HV inverter system as shown in FIG. 5.

FIG. 7A depicts the current balance circuit 510 in more details. The current balance circuit 510 has a current transformer CT with two input and two output winding ends, and a number of windings W1-W2 coupled in parallel to the backlight lamps 212. The windings W1-W2 have the same magnetic core and winding number. All currents flowing through the windings W1-W2 are equal, and balance among the currents to the lamps is therefore achieved.

Figure 7B:
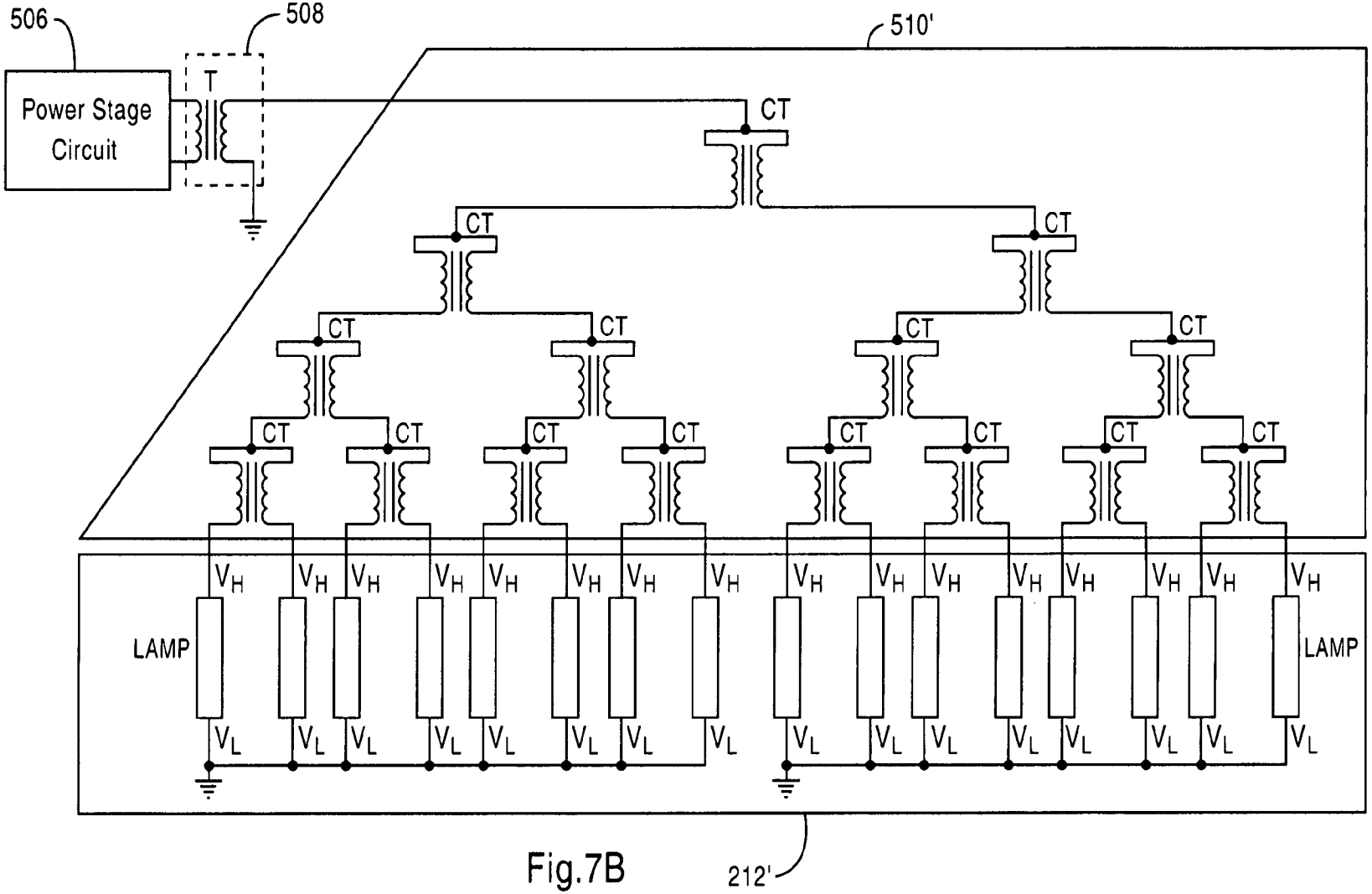
FIGS. 7B-7D are selective circuit diagrams showing various symmetric multi-tier configurations for the current balance circuit of the HV inverter system as shown in FIG. 5.
Figure 7C:
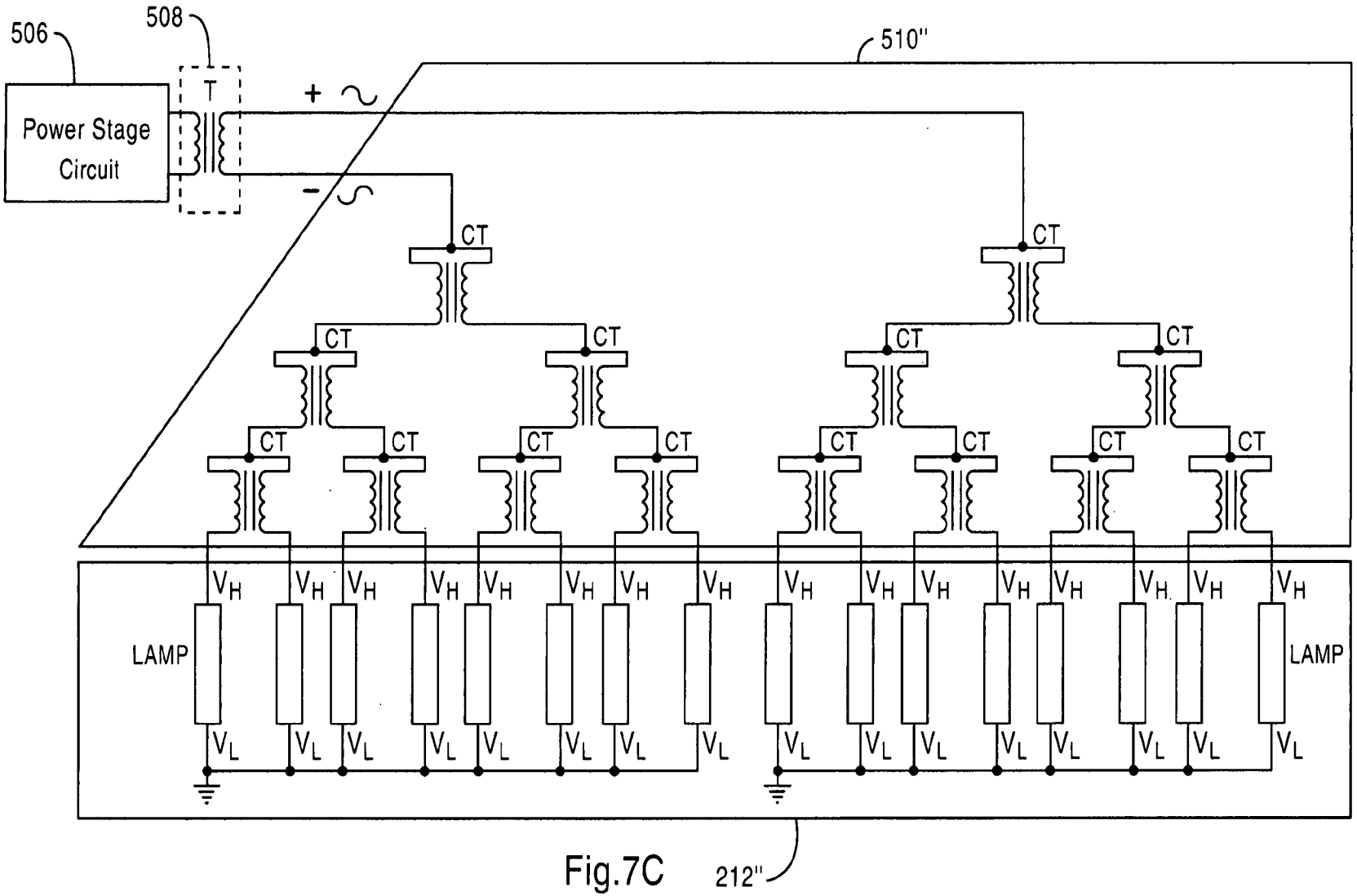

FIGS. 7B-7C illustrate different configurations for the current balance circuit in connection with one or more CCFL/EEFL lamps. In FIG. 7B, the multi-tier arrangement of the current transformers (CT) in a current balance circuit 510' allows simultaneous powering of a large number of backlight lamps 212' while balancing the currents flowing therein. Particularly, one or more current transformers CT are sequentially connected to each other to form a pyramid-like or multi-tier structure. Each of the two ends of the current transformer CT at the bottom level of the multi-tier structure is connected to a high voltage end $V_H$ of one of the lamps, while a low voltage end $V_L$ of the lamps is grounded. The configuration shown in FIG. 7B illustrates a symmetrically arranged structure for the current transformers CT, with a single polarity (i.e., positive polarity) from the transformer circuit 508 (i.e., negative polarity is grounded) provided first to both input winding ends of one of the current transformers CT, then to each output winding end of the current transformers CT providing a current signal to both input winding ends of the subsequent current transformers CT arranged in symmetrical sets.

The configuration shown in FIG. 7C illustrates a symmetrically arranged sets of the current transformers CT similar to that shown in FIG. 7B, except that a negative polarity from the transformer circuit 508 is provided to both input winding ends of a current transformer CT from one set, and a positive polarity from the transformer circuit 508 is provided to both input winding ends of a current transformer from the other set. However, in one or more later discussed embodiments, the current transformers CT can be asymmetrically arranged according to the number of lamps.

Figure 7D:
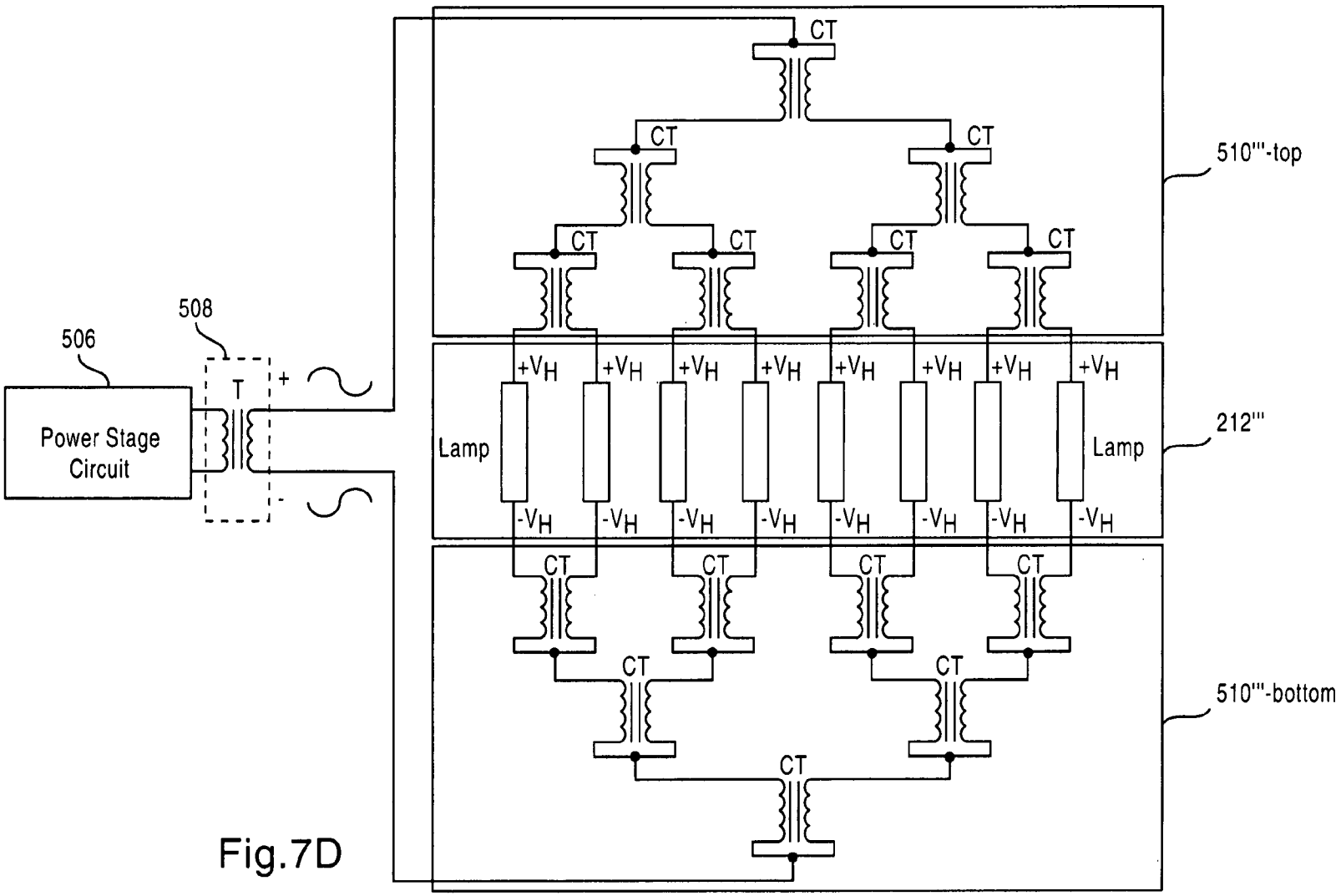

In FIG. 7D, another configuration is shown, in which a first balance circuit 510'''-top is connected to a high positive voltage end $+V_H$ in each of the lamps, while a second balance circuit 510'''-bottom is connected to a high negative voltage end $-V_H$ in each of the lamps. Additionally, the positive polarity from the transformer circuit 508 is coupled to a current transformer CT in the first balance circuit 510'''-top, while the negative polarity is coupled to another current transformer CT in the second balance circuit 510'''-bottom. The first balance circuit 510'''-top and the second balance circuit 510'''-bottom are symmetrically arranged with respect to the backlight lamps 212'''. In this current balance configuration, the lamps can be CCFL, EEFL comprising ordinary-type, U-type, S-type, or L-type lamps.

Additionally, in the multi-tier configurations as shown in FIGS. 7B-7C, which can have three tiers, namely a top tier, a middle tier, and a bottom tier, the top tier can have one or two current transformers for receiving AC signals (positive and/or negative) from the transformer circuit, while the bottom tier can have a plurality of the current transformers with windings that correspond to the number of the backlight lamps. Also, each current transformer on the bottom tier can be connected to a high voltage end of each of the backlight lamps. As to the middle tier, it is disposed between the top tier and the bottom tier, and comprised of a set of current transformers that are of no more than the number of the current transformers in the bottom tier.

Referring specifically to the multi-tier configuration as shown in FIG. 7D, it has two sets of current transformers that are symmetrically arranged relative to the backlight lamps such that the backlight lamps are disposed therebetween. The first set has one of the current transformers at the top tier thereof to receive a positive polarity current from the transformer circuit, and a number of current transformers with the number of windings corresponding to the number of the backlight lamps at a bottom tier thereof to connect to a positive high voltage end of each of the backlight lamps. The second set has one of the current transformers at a bottom tier thereof to receive a negative polarity current from the transformer circuit, and a number of current transformers with the number of windings corresponding to the number of the backlight lamps at the top tier thereof to connect to a negative high voltage end of each of the backlight lamps.

Figure 7E:
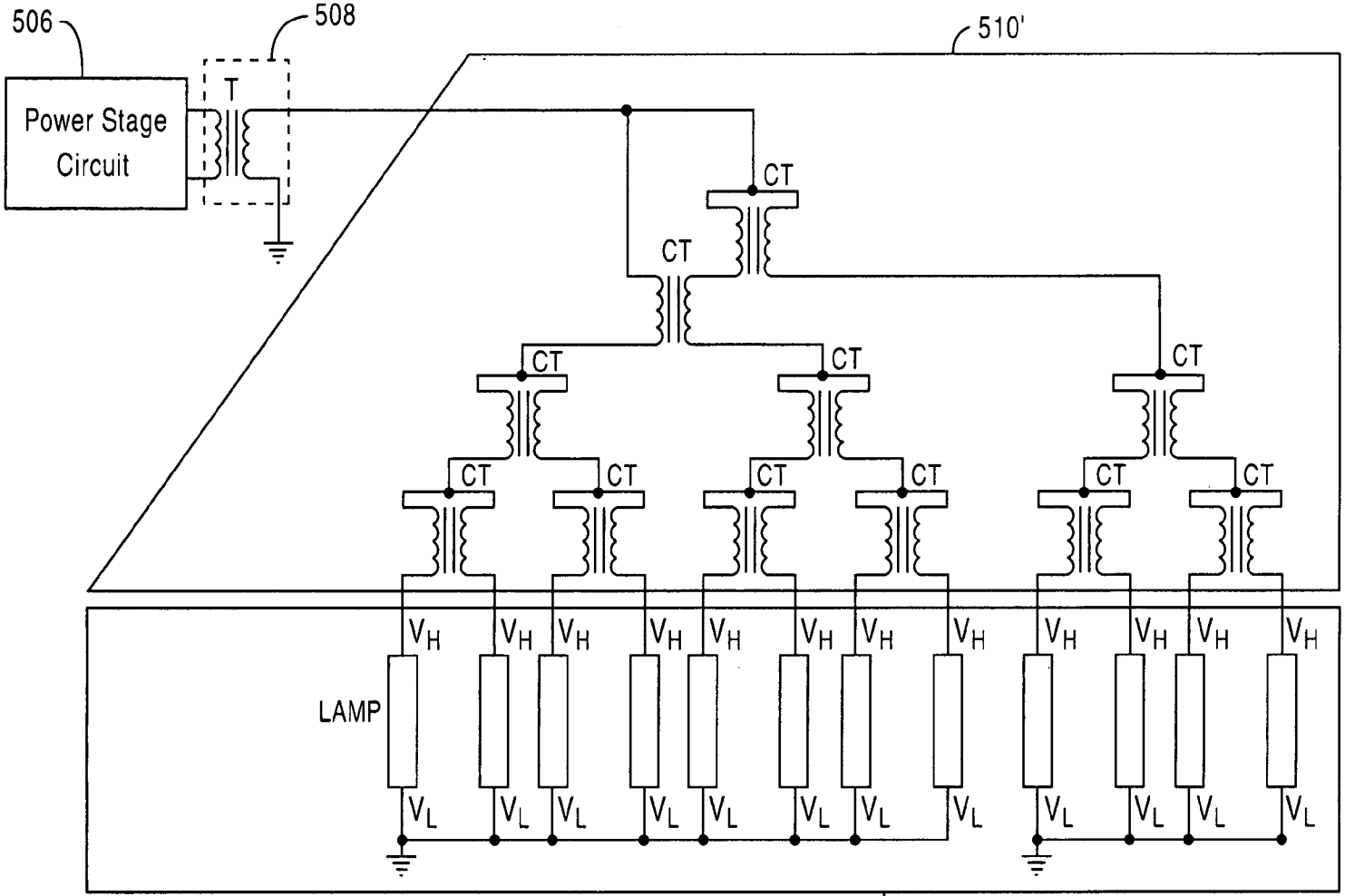
FIGS. 7E-7G are selective circuit diagrams showing various asymmetric multi-tier configurations for the current balance circuit of the HV inverter system as shown in FIG. 5.

As shown in FIG. 7E, the current transformers CT can be arranged asymmetrically. The number of lamps used in an LCD determines symmetrical or asymmetrical arrangement of the current transformers CT. For example, an LCD with 4, 8, 16, 32 or any other like number of lamps requires symmetrically arranged sets of the current transformers CT, and an LCD with 3, 5-7, 9-15, 17-31 or any other like number of lamps requires asymmetrically arranged sets of the current transformers CT. To illustrate, the configuration shown in FIG. 7E has 12 lamps, and therefore, the current transformers CT are shown as asymmetrically arranged and positioned at different or separate tiers.

Particularly, both of the two input winding ends of the current transformer CT at a top tier are receiving the same polarity current, while only one of the input winding ends of the other transformer CT at one of the middle tiers is receiving the same polarity current. To achieve current balance in this asymmetrically arranged structure, it is necessary for the other input winding end of the other transformer CT of the middle tier to be connected to one of the output winding ends of the current transformer CT of the top tier.

Figure 7F:
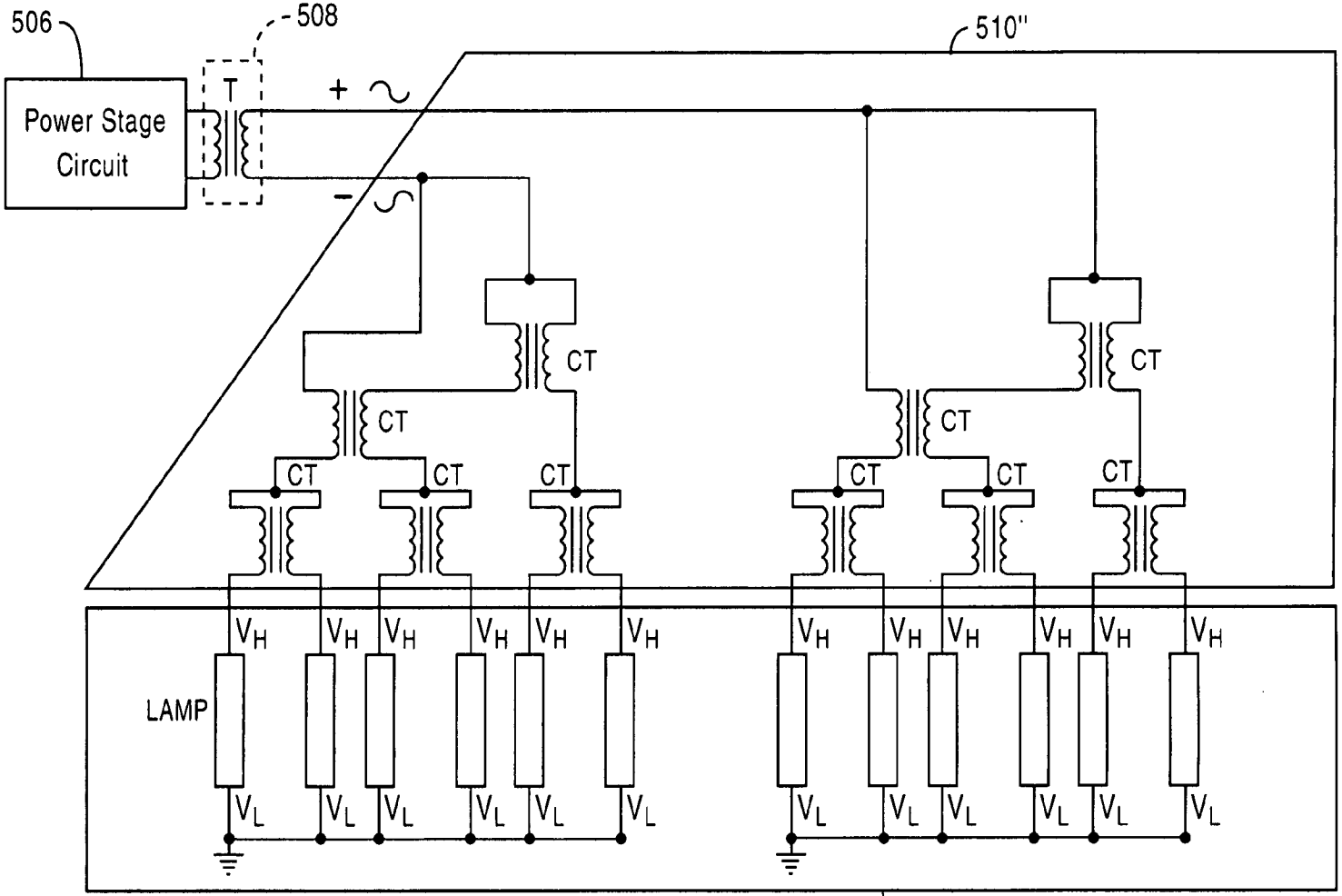

In FIG. 7F, an asymmetrically arranged sets of the current transformers CT with dual (i.e., positive and negative) polarities from the transformer circuit 508 are shown. The first asymmetrically arranged set has two of the current transformers positioned at different or separate tiers to receive a negative polarity current from the transformer circuit, with a number of current transformers at another tier that is closest to the backlight lamps having a number of windings that correspond to the number of the positive high voltage end of each of the backlight lamps.

Specifically, both input winding ends of the current transformer CT at a top tier receive the negative polarity current, while only one of the input ends of the other transformer CT at a middle tier receives the same negative polarity current. To achieve current balance in this asymmetrically arranged structure, it is necessary for the other input winding end of the other transformer CT of the middle tier to be connected to one of the output ends of the current transformer CT of the top tier.

The second asymmetrically arranged set is similar to the first asymmetrically arrange set except that a positive polarity current from the transformer circuit is provided. Although the two current transformers CT from each set are depicted at different tiers, they can be arrange at the same tier as long as the one of the output winding ends from one transformer CT is connected directly to one of the input winding ends of the other transformer CT.

Figure 7G:
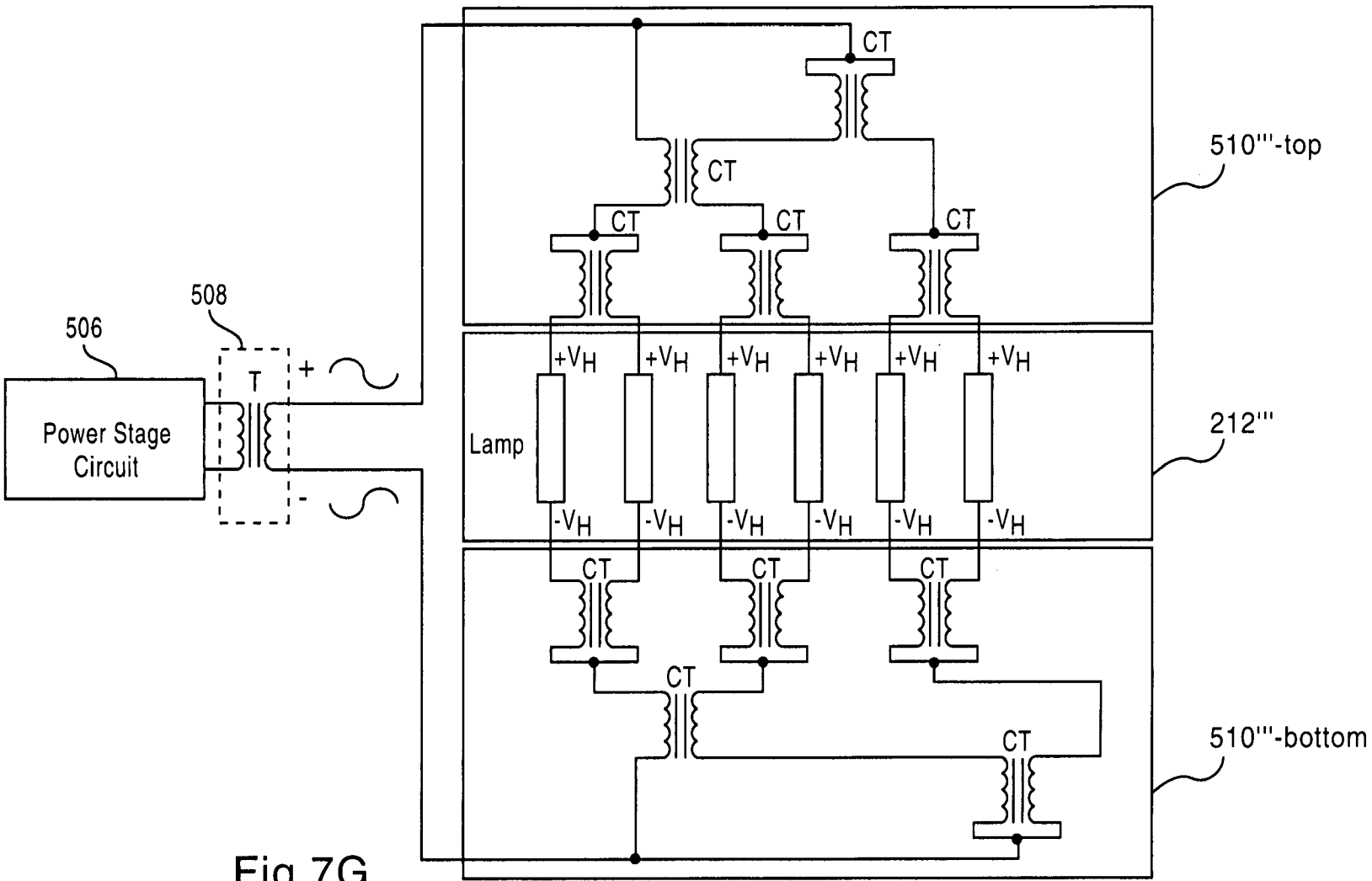

FIG. 7G shows two asymmetrically arranged sets of current transformers that are oppositely positioned relative to the backlight lamps such that the backlight lamps are disposed therebetween. The first set has two of the current transformers positioned at different or separate tiers to receive a positive polarity current from the transformer circuit, and a number of current transformers with the number of windings corresponding to the backlight lamps at a bottom tier thereof to connect to a positive high voltage end of each of the backlight lamps. The second group also has two of the current transformers at separate tiers to receive a negative polarity current from the transformer circuit, and a number of current transformers with the number of windings corresponding to the backlight lamps at the top tier thereof to connect to a negative high voltage end of each of the backlight lamps.

Figure 8:
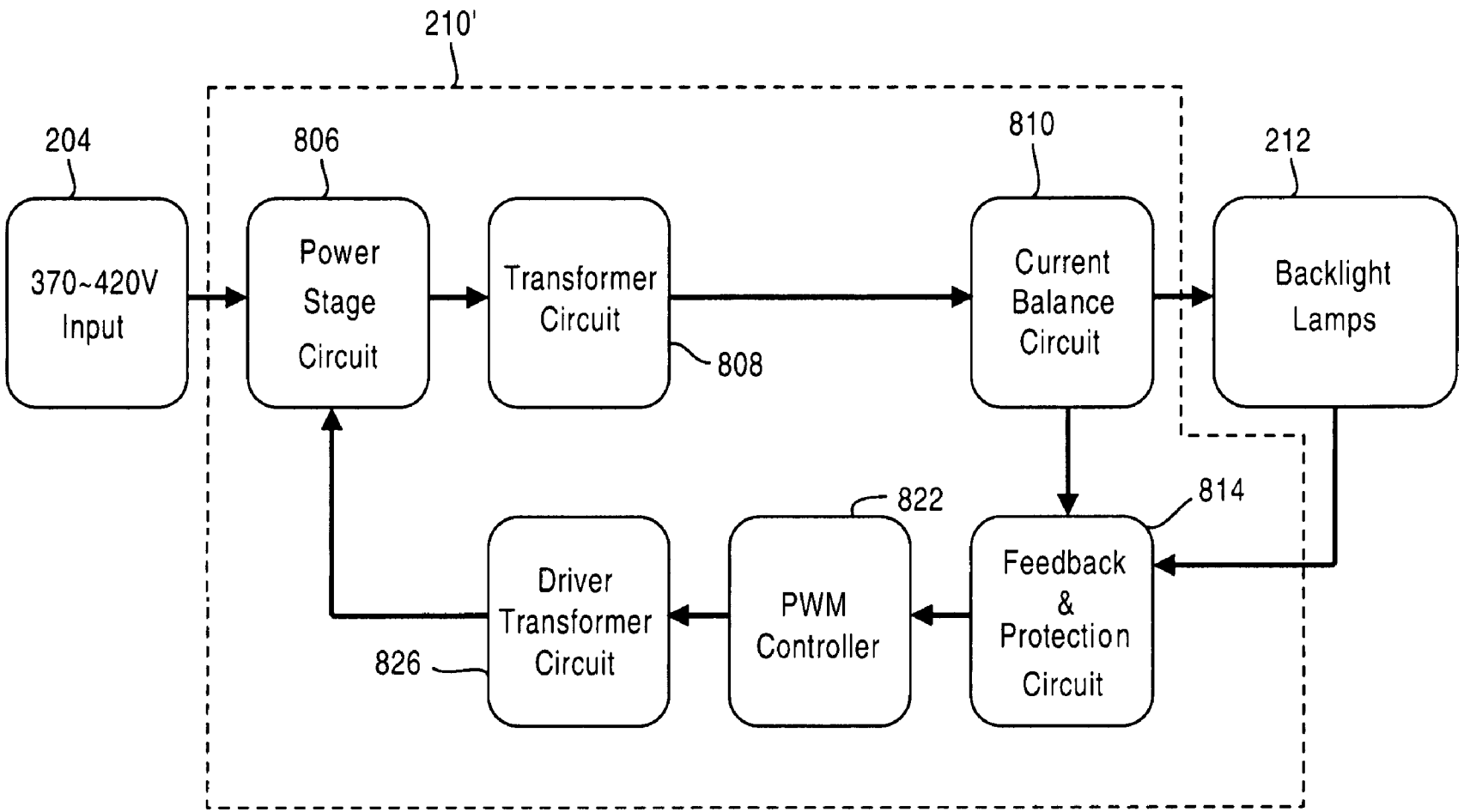
FIG. 8 is a block diagram illustrating an HV inverter system in the power supply system according to a second exemplary embodiment.

FIG. 8 shows a block diagram for another exemplary embodiment of the backlight lamp power supply system. The DC voltage that ranges from 370 to 420 volts from the AC-DC converter circuit 204 is fed to another HV inverter system 210', which has at least a power stage circuit 806, a transformer circuit 808, and a current balance circuit 810. In particular, the DC signal is converted to an AC signal via the power stage circuit 806 and is fed to the transformer circuit 808, and then to the current balance circuit 810, which is coupled to the backlight lamps (CCFL/EEFL) 212. The HV inverter system 210' also has a feedback and protection circuit 814, a PWM controller 822, and a driver transformer circuit 826, so that feedback and protection signals from the current balance circuit 810 and the backlight lamps 212 are received, and output signal is outputted to the PWM controller 822. The PWM controller 822 receives an output signal from the feedback and protection circuit 814 and provides an output signal to the driver transformer circuit 826 to protect the backlight lamps 212.

Figure 9A:
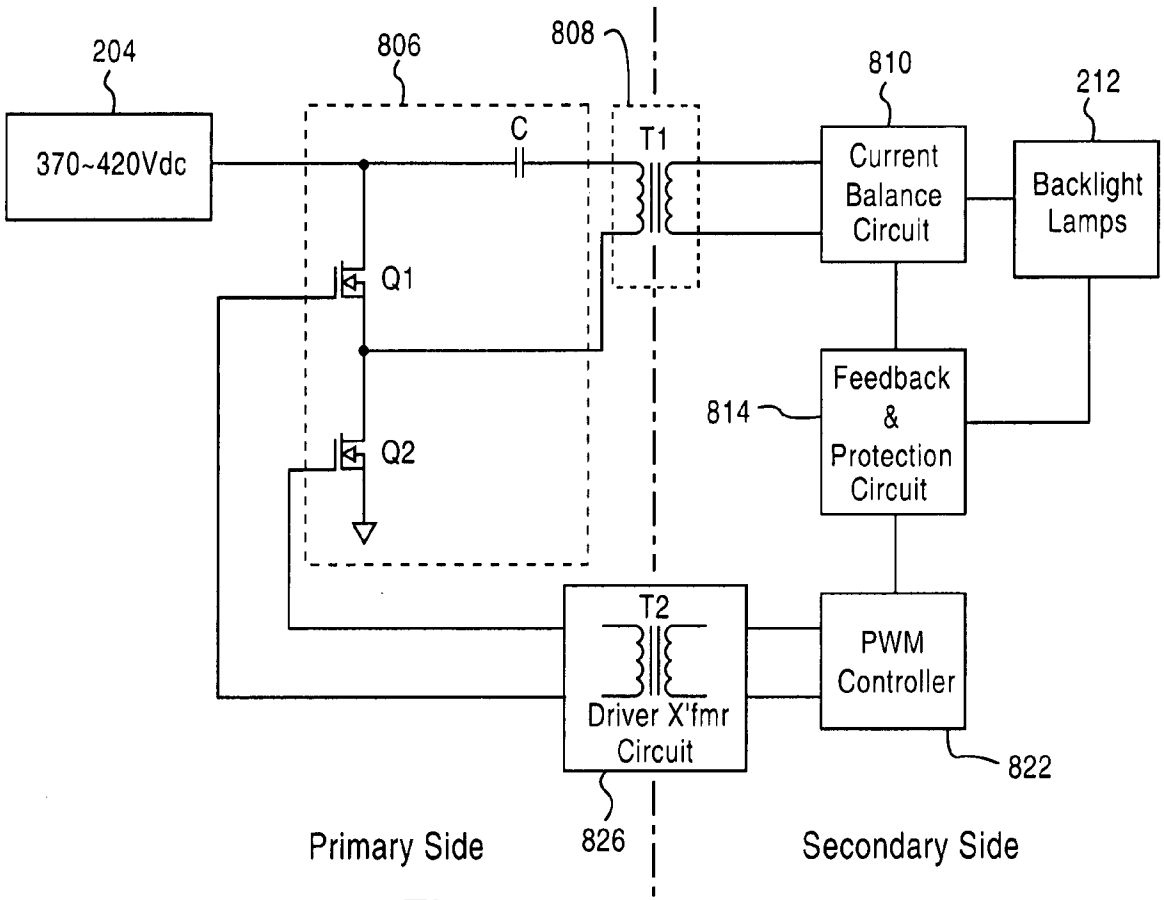
FIGS. 9A and 9B are selective circuit diagrams showing topology for a power stage circuit, a transformer circuit, and driver transformer circuit of the HV inverter system as shown in FIG. 8.
Figure 9B:
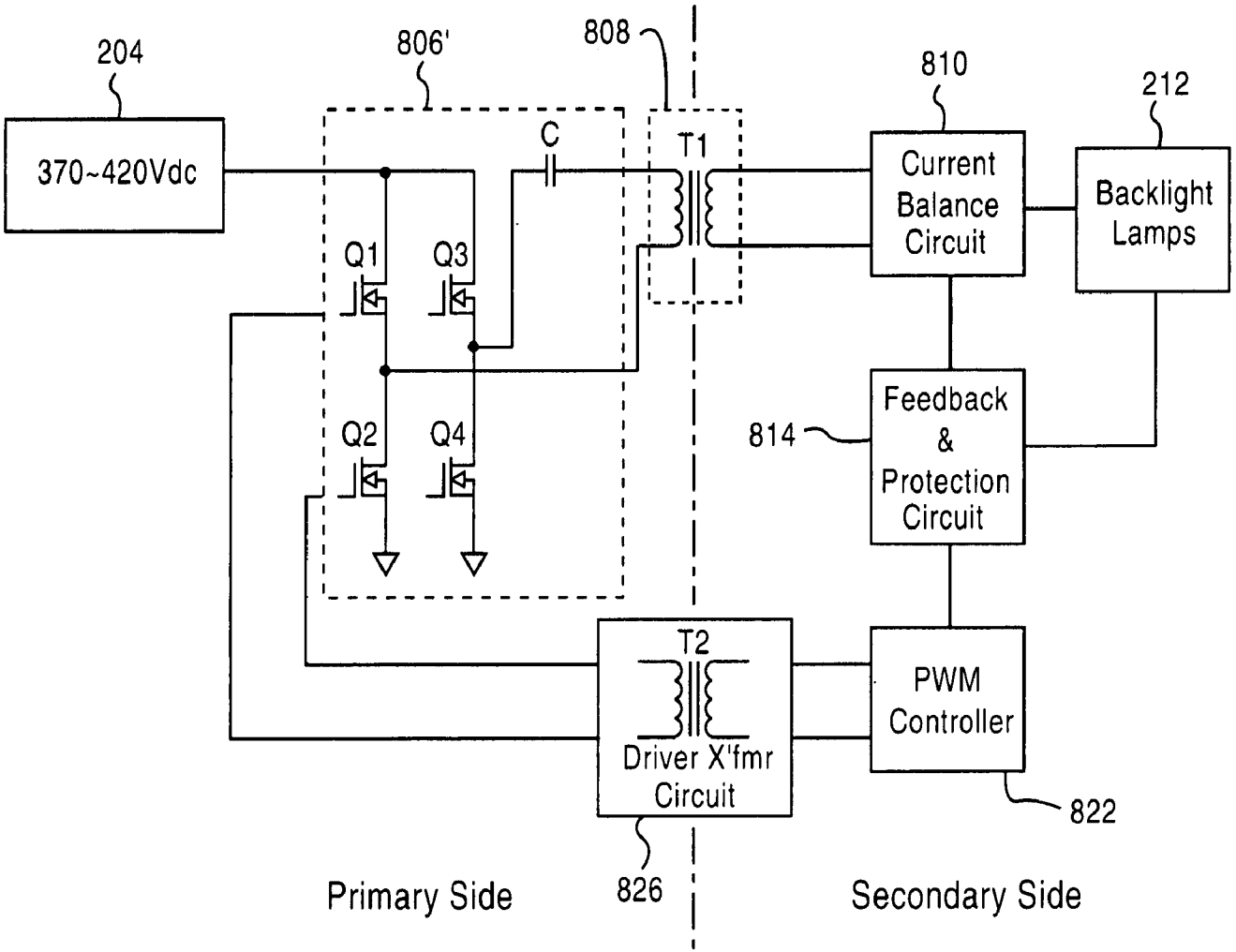

FIGS. 9A and 9B more clearly depict the circuitry in the power stage circuit 806, the transformer circuit 808, and the driver transformer circuit 826 as shown in FIG. 8. In the power stage circuit 806 as shown in FIG. 9A, Q1 and Q2 denote main switching elements, each including a pair of power MOSFETs. Particularly, the power MOSFETs Q1 and Q2 are coupled in a half-bridge manner and act as electronic switches for upper and lower halves of the power stage circuit 806. By switching on Q1, current is made to flow through the upper half of the power stage circuit 806. Conversely by switching on Q2, the current is made to flow the opposite way through the lower half of the power stage circuit 806. By switching the two MOSFETs on alternately, the current is made to flow first in one half and then in the other, producing an alternating magnetic flux. Alternatively, FIG. 9B shows a full bridge configuration for the power stage circuit 806 in which a drain and a source from MOSFETs Q1 and Q2 are connected directly to the transformer circuit 808, while a drain and a source of MOSFETs Q3 and Q4 are connected to the transformer circuit 808 via a capacitor (C).

The transformer circuit 808 in FIGS. 9A and 9B is depicted by a transformer (T1) with a primary side and a secondary side. More specifically, the primary side of the transformer (T1) has the capacitor (C) for signal block and storage. The secondary side of the transformer (T1) steps up the AC voltage and outputs it to the backlight lamps 212 via the current balance circuit 810. The driver transformer circuit 826 is represented by a transformer (T2).

It is noted that the current balance configurations described in FIGS. 7A-7D can also be applied in this exemplary embodiment, and thus, further description is omitted.

Figure 10:
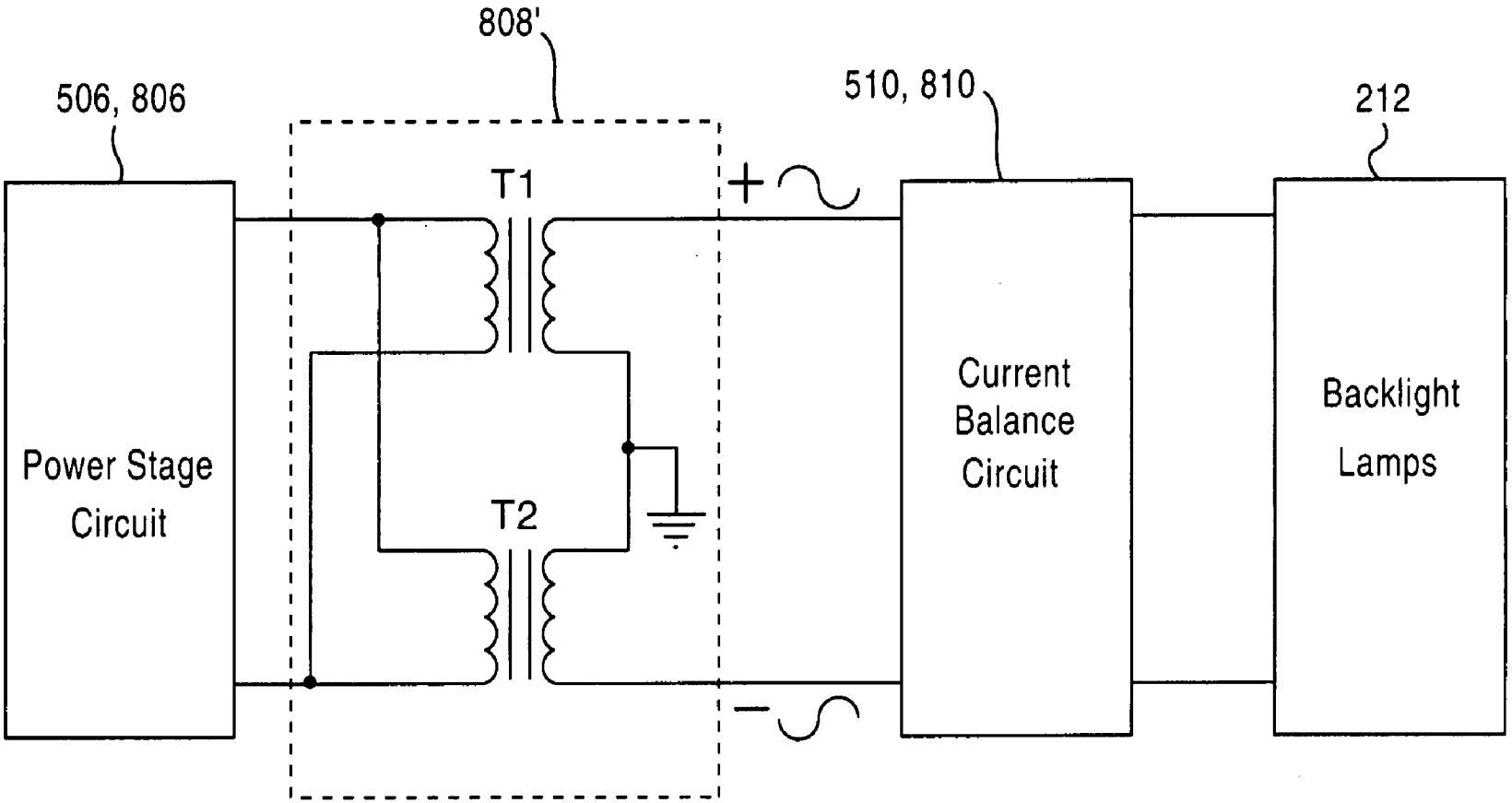
FIG. 10 is a circuit diagram showing the a configuration of the transformer circuit as shown in FIGS. 5 and 8.
Figure 11:
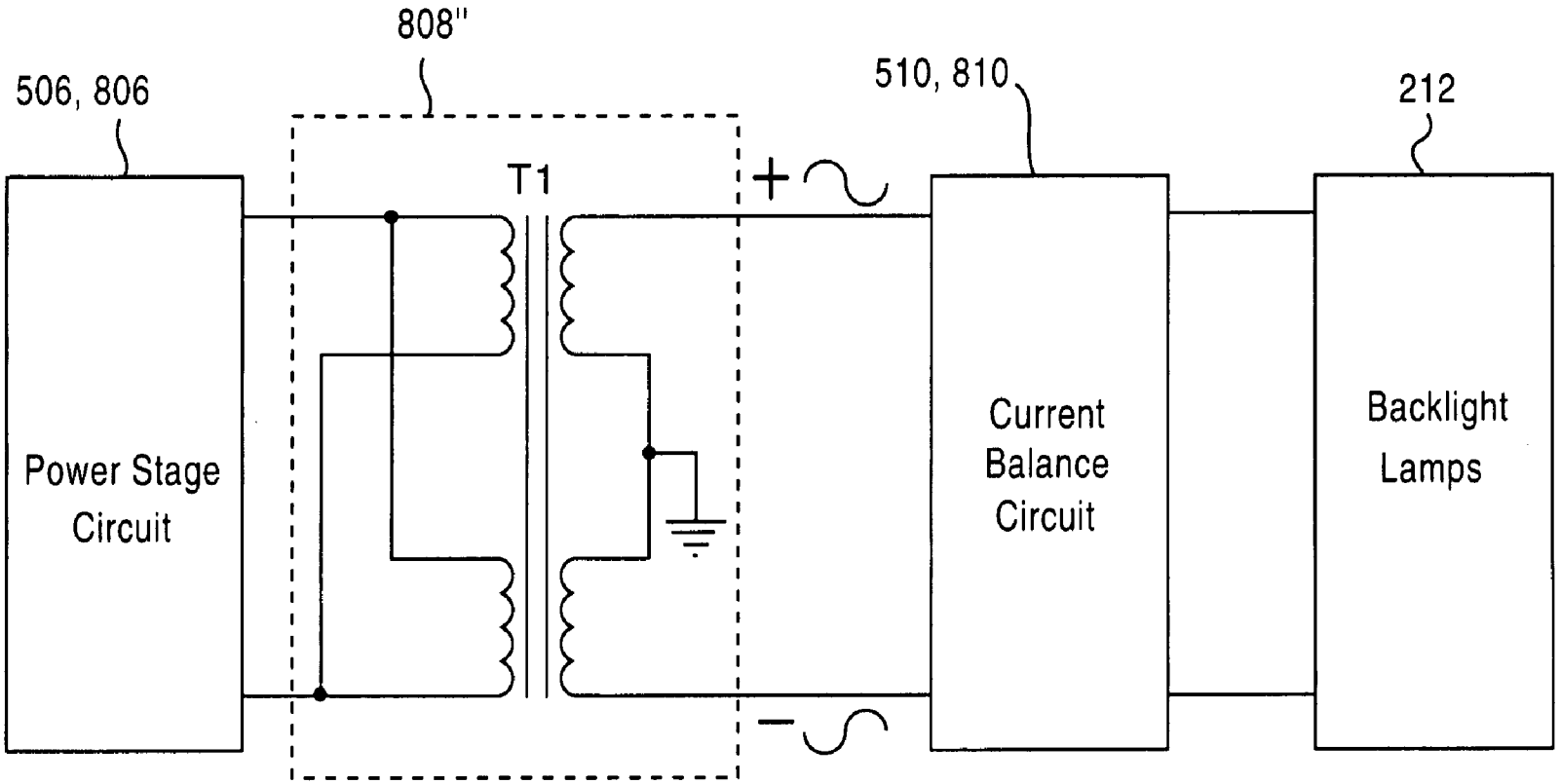
FIG. 11 is a circuit diagram showing another configuration of the transformer circuit as shown in FIGS. 5 and 8.
Figure 12:
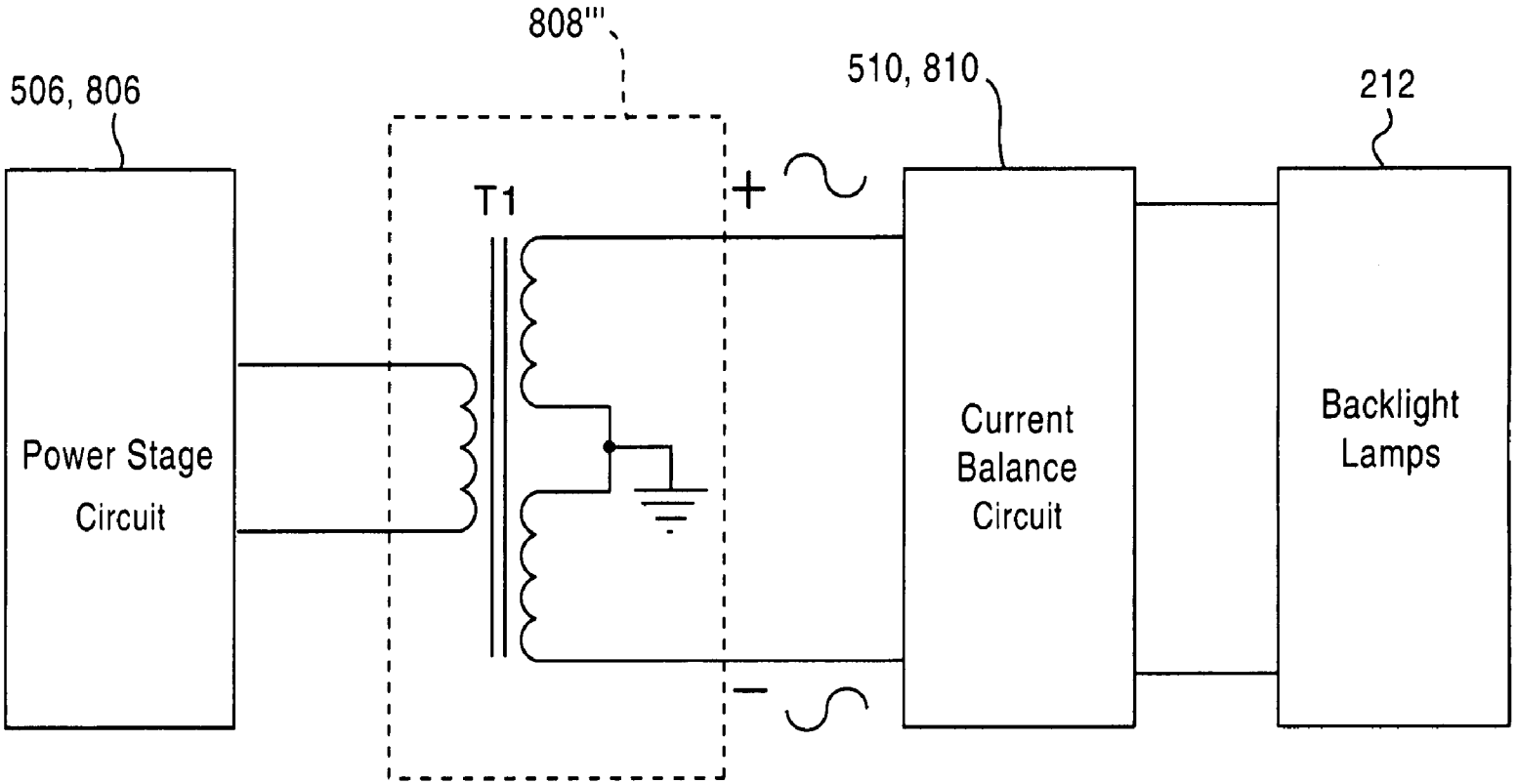
FIG. 12 is a circuit diagram showing yet another configuration of the transformer circuit as shown in FIGS. 5 and 8.

FIGS. 10-12 illustrate various configurations of the transformer circuit to increase output power. In FIG. 10, a transformer circuit 808' comprises two transformers T1 and T2, aligned and coupled to the power stage circuit 506 or 806 at each primary side, and arranged to provide dual polarities to the current balance circuit 510 or 810 and power backlight lamps 212. In FIG. 11, a transformer circuit 808" comprises a single transformer with two primary sides coupled to the power stage circuit 506 or 806, and arranged to provide dual polarities to the current balance circuit 510 or 810 and power backlight lamps 212. In FIG. 12, another transformer circuit 808''' comprises a single transformer with one primary side coupled to the power stage circuit 506 or 806, and arranged to provide dual polarities to the current balance circuit 510 or 810 and power the backlight lamps 212.

Figure 13:
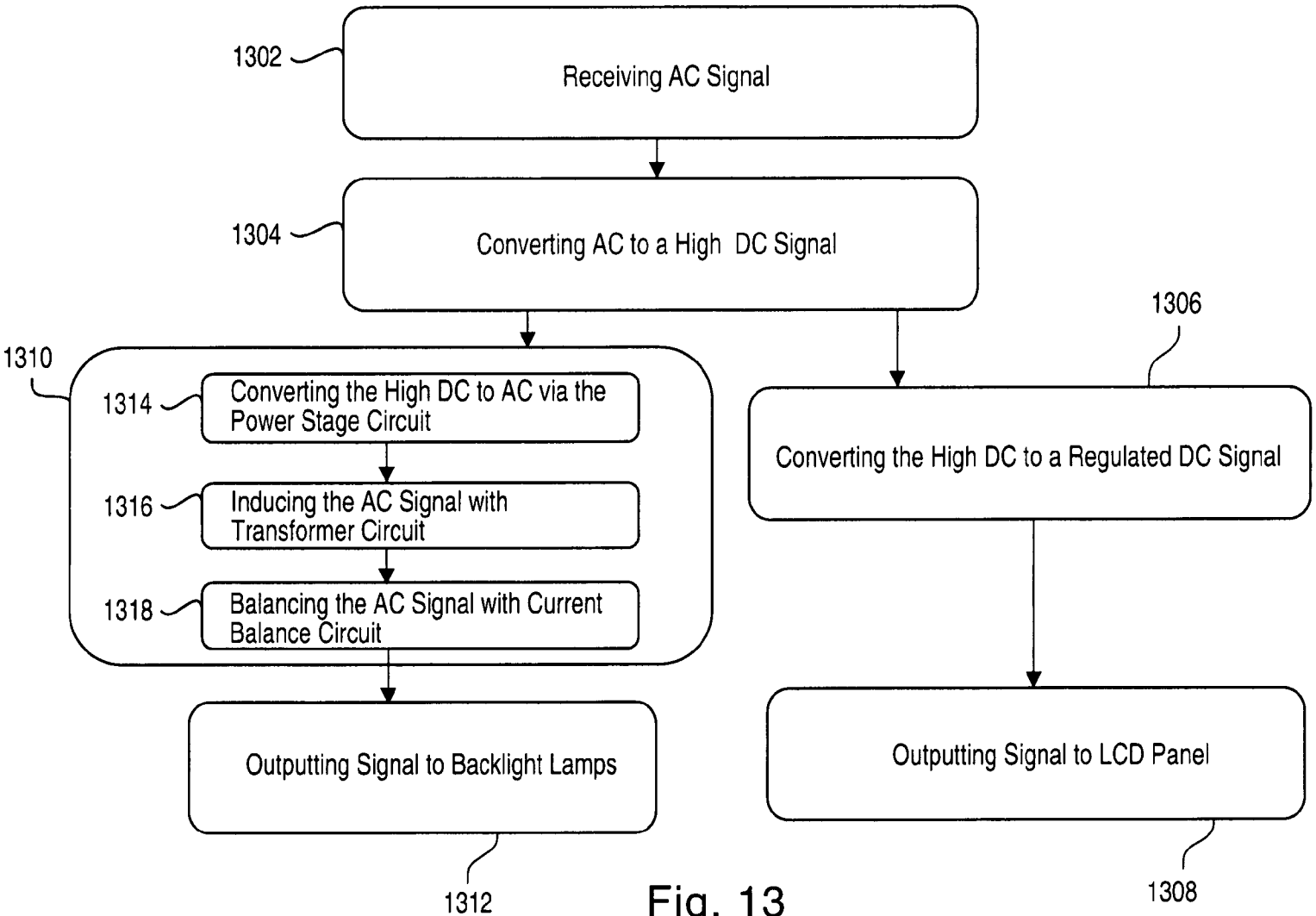
FIG. 13 is a flowchart showing the steps for powering the backlight lamps and LCD panel according to the exemplary embodiment.

FIG. 13 depicts a flowchart for powering the flat panel display devices. Particularly, an AC signal is received from an AC power source in step 1302, and then converted to a high DC signal in step 1304 through rectification and boost. Subsequently, the high DC signal is either converted to a regulated DC signal in step 1306 and outputted to an LCD panel in step 1308, or converted to an AC signal in step 1310 and outputted to backlight lamps in step 1310. In step 1310, the DC signal is converted to AC signal in three stages by converting the high DC signal with a power stage circuit in step 1314, inducing the AC signal with a transformer circuit in step 1316, and balancing the AC signal with a current balance circuit in step 1318.

Figure 14:
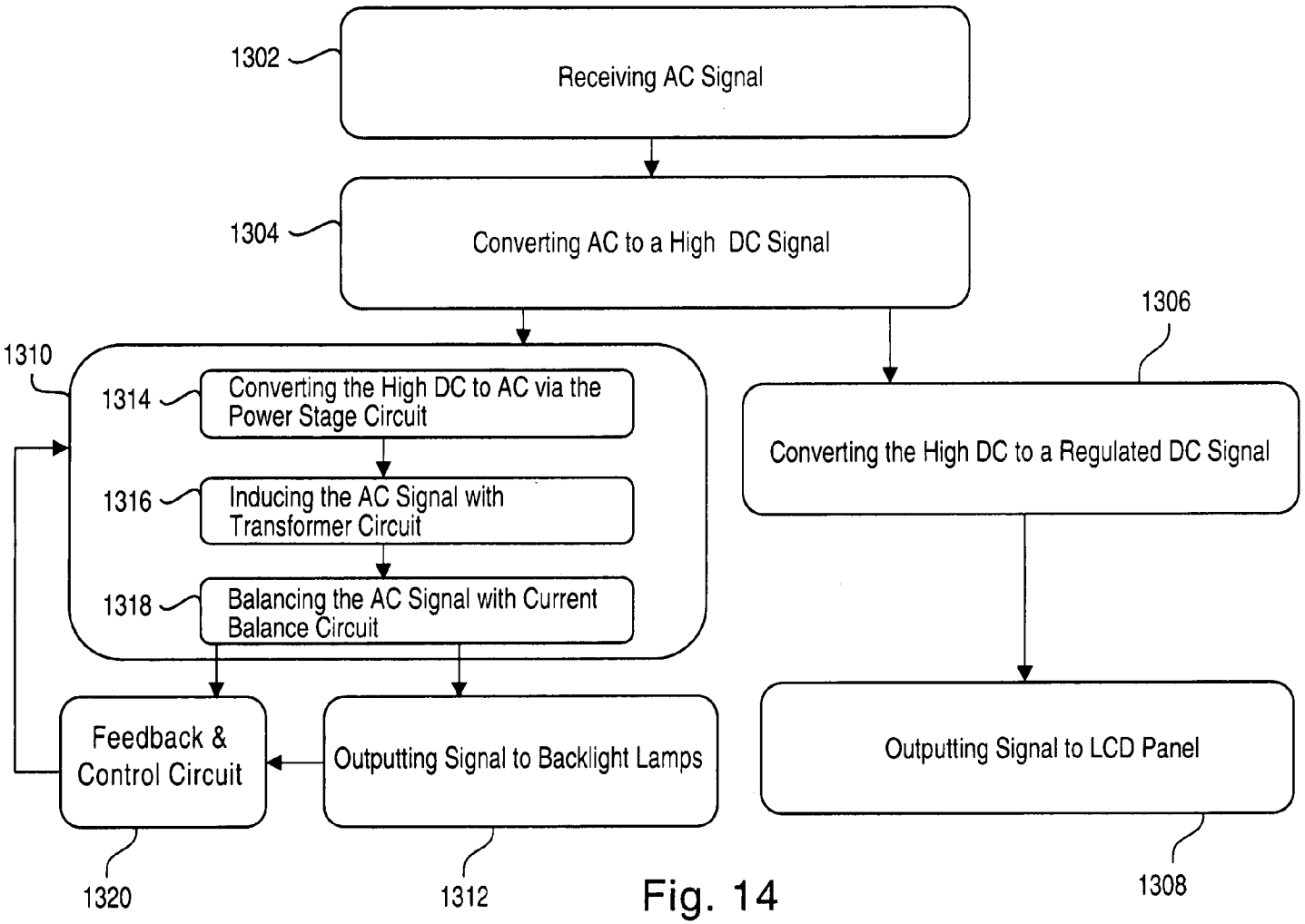
FIG. 14 is another flowchart showing optional steps for powering the backlight lamps and LCD panel according to the exemplary embodiment.

FIG. 14 further depicts an additional step 1320, which receives feedback signals from step 1312 and step 1318, and provides an output signal to the power stage circuit in step 1314. Accordingly, step 1320 provides detection of feedback signals and overload protection to the converted AC signal.

The power supply system according to the exemplary embodiments would increase power efficiency over the typical power supply system. Additionally, material costs are saved and fabrication costs are lowered due to reduced dimensions and product size.

Though the following description details a power supply system for illuminating backlight lamps, after reading the description, it will be apparent to persons skilled in the relevant art how to implement the invention using any other lamp powering or driving system.

Skilled persons will also understand that the use of any terms throughout the specification depicting particular mechanical elements, hardware, software, or combinations thereof, are provided by way of example, not limitation, and that the present invention can be utilized and implemented by any systems and methods presently known or possible without escaping from the features and functions disclosed herein.

While various exemplary embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A power supply system for flat panel display devices, comprising:

a converter circuit, receiving an alternating current (AC) signal from an AC power source, and converting the received AC signal into a high direct current (DC) signal; and a high voltage (HV) inverter system coupled to the converter circuit for receiving the high DC signal from the converter circuit, and configured to convert the high DC signal into an AC output voltage to power one or more backlight lamps, wherein the HV inverter system comprises:

a transformer circuit;

a power stage circuit coupled to a primary side of the transformer circuit; and a current balance circuit coupled between a secondary side of the transformer circuit and the backlight lamps;

wherein the current balance circuit comprises a plurality of current transformers, each of which comprises at least two windings, connected in a multi-tier configuration to balance each current flowing to the backlight lamps, and each current transformer comprises dual input and output winding ends, with one of the dual output winding ends from one of the current transformers coupled exclusively to one of the dual input winding ends of another one of the current transformers.

2. The system of claim 1, wherein the converter circuit comprises a rectifier circuit and a power factor correction (PFC) boost circuit for rectifying an AC input signal into a DC output signal.

3. The system of claim 1, wherein the transformer circuit comprises a transformer with a primary side coupled to the power state circuit, and a secondary side coupled to the current balance circuit.

4. The system of claim 3, wherein the power stage circuit comprises a pair of transistors in a half-bridge or full-bridge configuration, and a capacitor connected between one of the transistors and the transformer on the primary side.

5. The system of claim 1, further comprising an additional converter circuit coupled to the converter circuit for receiving the high DC signal from the converter circuit, and configured to generate a regulated DC output signal to an LCD (liquid crystal display) panel.

6. A power supply system for flat panel display devices, comprising:

a converter circuit, receiving an alternating current (AC) signal from an AC power source, and converting the received AC signal into a high direct current (DC) signal; and a high voltage (HV) inverter system coupled to the converter circuit for receiving the high DC signal from the converter circuit, and configured to convert the high DC signal into an AC output voltage to power one or more backlight lamps, wherein the HV inverter system comprises:

a transformer circuit;

a power stage circuit coupled to a primary side of the transformer circuit; and a current balance circuit coupled between a secondary side of the transformer circuit and the backlight lamps;

wherein the current balance circuit comprises a plurality of current transformers, each of which comprises at least two windings, connected in a multi-tier configuration to balance each current flowing to the backlight lamps, and the multi-tier configuration comprises a top tier with two of the current transformers respectively receiving positive and negative polarity currents from the transformer circuit, and a bottom tier with a remainder of the plurality of current transformers each having a number of windings corresponding to the number of the backlight lamps.

7. The system of claim 6, wherein each current transformer of the bottom tier is connected to a high voltage end from each of the backlight lamps.

8. The system of claim 6, wherein the multi-tier configuration comprises at least one middle tier that is disposed between the top tier and the bottom tier, and said at least one middle tier comprises a plurality of current transformers that number no more than the current transformers of the bottom tier.

9. The system of claim 6, wherein the current transformers are symmetrically arranged.

10. The system of claim 6, wherein the current transformers are asymmetrically arranged.

11. A power supply system for flat panel display devices, comprising:

a converter circuit, receiving an alternating current (AC) signal from an AC power source, and converting the received AC signal into a high direct current (DC) signal; and a high voltage (HV) inverter system coupled to the converter circuit for receiving the high DC signal from the converter circuit, and configured to convert the high DC signal into an AC output voltage to power one or more backlight lamps, wherein the HV inverter system comprises:

a transformer circuit;

a power stage circuit coupled to a primary side of the transformer circuit; and a current balance circuit coupled between a secondary side of the transformer circuit and the backlight lamps;

wherein the current balance circuit comprises a plurality of current transformers, each of which comprises at least two windings, connected in a multi-tier configuration to balance each current flowing to the backlight lamps, with the multi-tier configuration having a first set and a second set, symmetrically arranged relative to the backlight lamps such that the backlight lamps are disposed therebetween, wherein the first set comprises one of the current transformers at a top tier thereof, receiving a positive polarity current from the transformer circuit, and the current transformers with the number of windings corresponding to the number of the backlight lamps at a bottom tier of the first set, connecting to a positive high voltage end of each of the backlight lamps, and the second set comprises one of the current transformers at a bottom tier thereof, receiving a negative polarity current from the transformer circuit, and the current transformers with the number of windings corresponding to the number of the backlight lamps at a top tier of the second set, connecting to a negative high voltage end of each of the backlight lamps.

12. The system of claim 11, wherein the first set further comprises at least one middle tier that is disposed between the top tier and the bottom tier, and said at least one middle tier comprises a plurality of current transformers that are no more than the number of the current transformers of the bottom tier.

13. The system of claim 11, wherein the second set further comprises at least one middle tier that is disposed between the top tier and the bottom tier, and said at least one middle tier comprises a plurality of current transformers that number no more than the current transformers of the top tier.

14. The system of claim 11, wherein the current transformers are symmetrically arranged.

15. The system of claim 11, wherein the current transformers are asymmetrically arranged.

* * * * *